United States Patent [19]

Rudolph, deceased et al.

[11] Patent Number: 4,463,671

[45] Date of Patent: Aug. 7, 1984

[54] SILK-SCREEN PRINTING METHOD AND APPARATUS

[76] Inventors: Rome R. Rudolph, deceased, late of Gibsonia, Pa.; by Kathleen Rudolph, executrix, 4113 Lee Rd., Gibsonia, Pa. 15044; Carl Strutz; Frank C. Strutz, both of R.D. 2, Camp Trees Rd., Mars, Pa. 16046

[21] Appl. No.: 436,922

[22] Filed: Oct. 26, 1982

Related U.S. Application Data

[63] Continuation of Ser. No. 270,869, Jun. 5, 1981, Pat. No. 4,428,283.

[51] Int. Cl.[3] ..... B41F 17/28; B41F 17/20

[52] U.S. Cl. ..... 101/35; 101/126; 101/129

[58] Field of Search ..... 101/35, 38 R, 38 A, 101/126, 129, 123, 124, 426

[56] References Cited

U.S. PATENT DOCUMENTS

| | | | |
|---|---|---|---|
| 2,111,207 | 3/1938 | Denelsbeck | 101/126 X |
| 2,113,605 | 4/1938 | Schutz | 101/38 R X |
| 2,166,269 | 7/1939 | Smith | 101/123 |
| 2,605,700 | 8/1952 | Martin | 101/123 |
| 2,895,412 | 7/1959 | Reed | 101/126 X |
| 2,918,866 | 12/1959 | Reed | 101/126 X |
| 3,054,345 | 9/1962 | Martin | 101/123 |
| 3,209,688 | 10/1965 | Eldred et al. | 101/126 X |
| 3,309,985 | 3/1967 | Nowak | 101/126 X |
| 3,316,837 | 5/1967 | Scheck | 101/126 X |

*Primary Examiner*—Clifford D. Crowder

*Attorney, Agent, or Firm*—Thomas H. Murray; Clifford A. Poff

[57] ABSTRACT

Printing on a cylindrical or conical surface of a container is carried out by a method and apparatus wherein the container is supported against rotation about a support axis. A squeegee is positioned at one side of a decorating screen to establish line contact between the opposite side of the screen and the surface of a container. The decorating screen is rolled along a tangential path about the surface of the container and concurrently the squeegee is moved along an orbital path about the support axis to force printing medium through the screen onto the surface of the container at the line of contact therewith.

17 Claims, 23 Drawing Figures

31
32
36
43
35
46
38
50
48
45
47
39
44
37
33
34
49
42
40
26
10
18
19
15
16
21
22
23
24
25
27
17
12
11
54
52
53
55
14

95C
95B
95A
95
10
55

50
51
56
39
57
77
78
58
82
61
64
62
62
59
76
79
52
76
81
60
65
71
75
54
53
74
72
73
55

Fig. 7
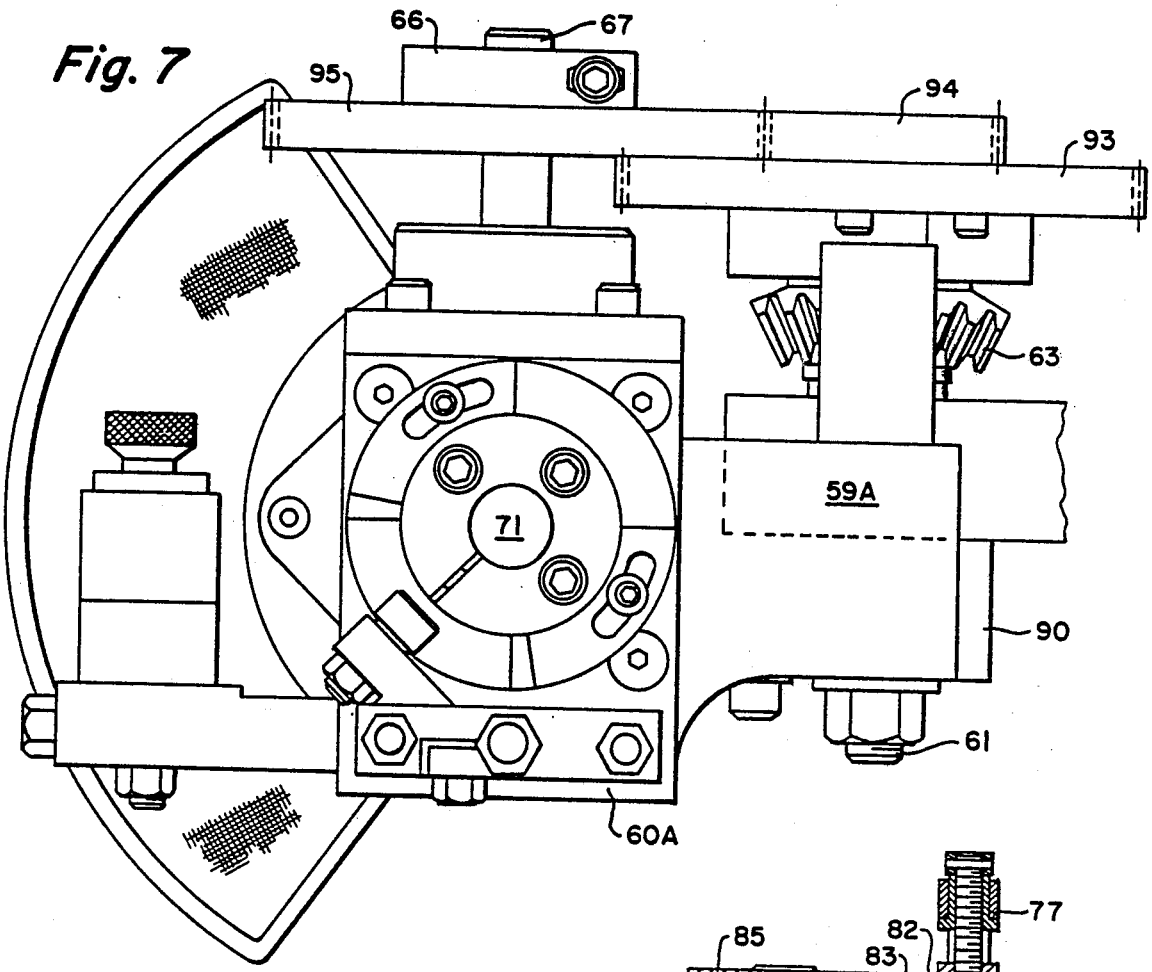
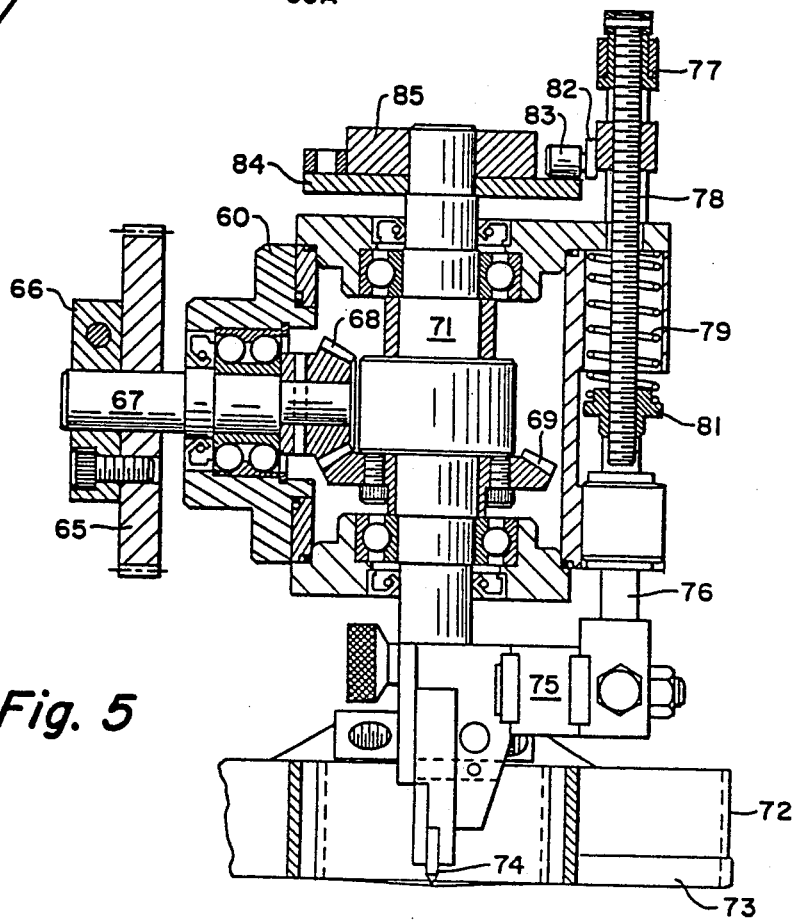
Fig. 5

SILK-SCREEN PRINTING METHOD AND APPARATUS

CROSS-REFERENCE TO RELATED APPLICATION

This application is a continuing application of application Ser. No. 270,869, filed June 5, 1981, now U.S. Pat. No. 4,428,283.

BACKGROUND OF THE INVENTION

This invention relates to a method and apparatus for decorating a surface of a workpiece, and more particularly, to a method and apparatus wherein a workpiece is held against rotation about a support axis while a decorating screen rolls along a tangential path about the surface of the workpiece and concurrently a squeegee is moved along an orbital path about the support axis to force ink through the screen onto a conical or cylindrical surface of the workpiece at a line of contact therewith.

An intermittent motion-type decorating machine is known in the decorating field of art wherein a drive is provided to impart an intermittent traveling motion to a workpiece such as bottles made of glass, plastic or the like as well as other forms of containers. The bottles are moved through a predetermined distance, stopped, moved again through a predetermined distance, stopped and so forth until each bottle has moved completely through the decorating machine. A decorating station may be provided at each of the places where the bottles come to a complete stop. At a decorating station, a decorating screen is displaced into line contact with the surface of the bottle by an associated squeegee. The bottle is rotated and the squeegee remains stationary in alignment with the axis of rotation of the bottle. The screen is passed or moved across the bottle while in rolling contact therewith. Examples of such intermittent motion-type decorating machines will be found, for example, in U.S. Pat. Nos. 2,231,535, 2,261,255, 2,721,516 and 3,146,704.

Other decorating apparatus take the form of a continuous motion-type decorating machine wherein the workpieces, such as bottles, are conveyed through the machine at a constant linear speed. At each of a succession of decorating stations along the path of travel, there is a decorating screen which remains stationary with respect to the station and a squeegee displaces the screen into line contact with the bottle. The squeegee is moved in the same direction and at the same velocity as the workpiece which is rotated about its longitudinal axis while in rolling contact with the stationary or moving decorating screen. Examples of a continuous motion-type decorating machine will be found, for example, in U.S. Pat. Nos. 2,027,102, 2,121,491, 2,132,818 and 3,251,298.

In either the continuous-type or intermittent-type decorating machines, a small amount of slippage usually occurs at the driven connection between the bottle and rotational drive shaft. Typically, the bottle is engaged by a neck chuck at one end and a base chuck at its opposite end. Misalignment between the rotational axis of a neck or base chuck with respect to the longitudinal axis of the bottle will bring about a slippage during each revolution of the bottle. Slippage also occurs due to surface and shape irregularities on the bottle at the sites engaged by the neck and base chucks. Such slippage will distort the printed pattern which is defined by the flow of ink or other printing medium through open spaces in the screen. Such distortion is undesirable, but it is far more detrimental to the appearance of the decorative imprint when comprised of two or more colors because any small amount of misregistration between a previously-applied decorative imprint and the decorative imprint next to be applied is noticeable.

A minimum number of workpiece- or bottle-handling operations is desirable to not only reduce operator fatigue but also improve the quality of the decoration and/or printing. Because a drying time for the printing medium is usually necessary, newly-applied printing cannot be permitted to contact any surface, particularly a surface intended to support the bottle to avoid possible damage or smearing of the printing. Moreover, the actual printing operation must be designed for quality printing and to accommodate or make provisions for manufacturing tolerances that occur, for example, in a bottle formed in a mold from blown glass. Even small deviations from bottle-to-bottle are detrimental to quality printing. The top and base of a typical bottle will rarely fall within truly parallel planes. The chucks used to support and possibly rotate a bottle about a longitudinal axis must engage these surfaces. A perpendicular to the plane of the top of the bottle and a perpendicular to a plane of the base of the bottle will not normally coincide so as to form a single central axis of the bottle, whereby some eccentricity will normally occur when the bottle is held and/or rotated between chuck parts. Significant speed variations occur at a cylindrical midportion, for example, when the bottle is rotated. These speed variations adversely affect a necessary zero relative movement at a line of contact with a silk screen. This condition is further aggravated by the fact that cylindrical midportions of bottles, for example, have randomly-dispersed areas of distortion from a true cylindrical configuration so that a true central rotational axis of a bottle can rarely be established.

SUMMARY OF THE INVENTION

It is an object of the present invention to provide a method and apparatus for decorating a surface of a workpiece in which a decorating screen and squeegee associated therewith move along the surface of the workpiece while it is held against rotation, thereby eliminating undesirable slippage by the need to transmit torque to the workpiece.

It is a further object of the present invention to provide a method and apparatus for decorating a workpiece held against rotation during one or more sequential decorating operations wherein a squeegee is orbited about the surface of the workpiece and a decorating screen is moved tangentially about the surface of the workpiece to form line contact between the screen and the workpiece.

More particularly, according to the present invention there is provided a method of decorating a conical or cylindrical surface of a workpiece by the steps comprising supporting the workpiece against rotation about a support axis spaced from the surface of the workpiece for decorating, positioning a squeegee at one side of a decorating screen to establish line contact between the opposite side of the screen and the surface of the workpiece, rolling the decorating screen along a tangential path about the surface of the workpiece and concurrently therewith moving the squeegee along an orbital path about the support axis to force a printing medium through the screen onto the surface of the workpiece at the line of contact therewith.

Usually, the tangential path of the decorating screen is spaced from the surface of the workpiece and the squeegee is used to form line contact between the surface of the workpiece and the decorating screen. For decorating a cylindrical surface of a workpiece, the face of the screen forms a right angle with the support axis and moves about an axis corresponding to the support axis of the workpiece. The pivot axis of the screen forms an acute angle with the support axis when decorating a conical surface of the workpiece. In the preferred form, the workpiece is moved along a path of travel about an axis of an oscillating drive while supported against rotation when decorating the surface thereof.

In the apparatus of the present invention, means such as a chuck member and a base support engage opposite ends of the workpiece to support it against rotation about a support axis, a decorating screen including openings defining a desired pattern for printing on the surface of the workpiece, squeegee means to force a printing medium through openings in the screen, screen drive means to move the screen for rolling contact along a tangential path about the surface of the workpiece, squeegee drive means to move the squeegee means in an orbital path about the support axis of the workpiece to force a printing medium through the openings in the screen while in line contact with the workpiece, and housing means to move about the support axis of the workpiece for carrying the screen and squeegee drive means.

Means, such as a conveyor or an oscillating base, is preferably arranged to advance the workpieces along a path of travel during a decorating process. Housing means is provided for supporting the squeegee and screen. This housing means, in the preferred form, is rotated about the support axis of the workpiece. A carrier extending from the housing means supports the squeegee and reciprocates into and away from the screen as the housing means is rotated. The screen is supported and driven by a pivot shaft housed for rotation in the housing means. The screen drive means includes the pivot shaft, a pinion gear coupled to the pivot shaft and a drive gear supported by the housing means for rotation with the housing means about the support axis of the workpiece. The screen drive means further includes a train of gears meshing in driving relationship with the pinion gear and drive gear, and a bevel gear coupled to the drive gear and engaged for meshing rotation with a second bevel gear supported in a fixed, non-rotatable position about the support axis of the workpiece.

In an embodiment of the present invention, the aforesaid chuck member and oscillating base move about an axis at a synchronous speed during the actual decorating process. Thereafter, the chuck member is continuously rotated and lifted to carry the workpiece above the base to a discharge station while the base undergoes reverse oscillating motion to receive a further workpiece for a printing process. One or more decorating heads are supported by an oscillating base while the head or heads are rotated about the aforesaid support axis by an indexing drive.

These features and advantages of the present invention as well as others will be more fully understood when the following description of the various embodiments thereof is read in light of the accompanying drawings, in which:

FIG. 5 is a sectional view taken along line V—V of FIG. 3;

FIG. 7 is a sectional view taken along line VII—VII of FIG. 6;

Figure 1:
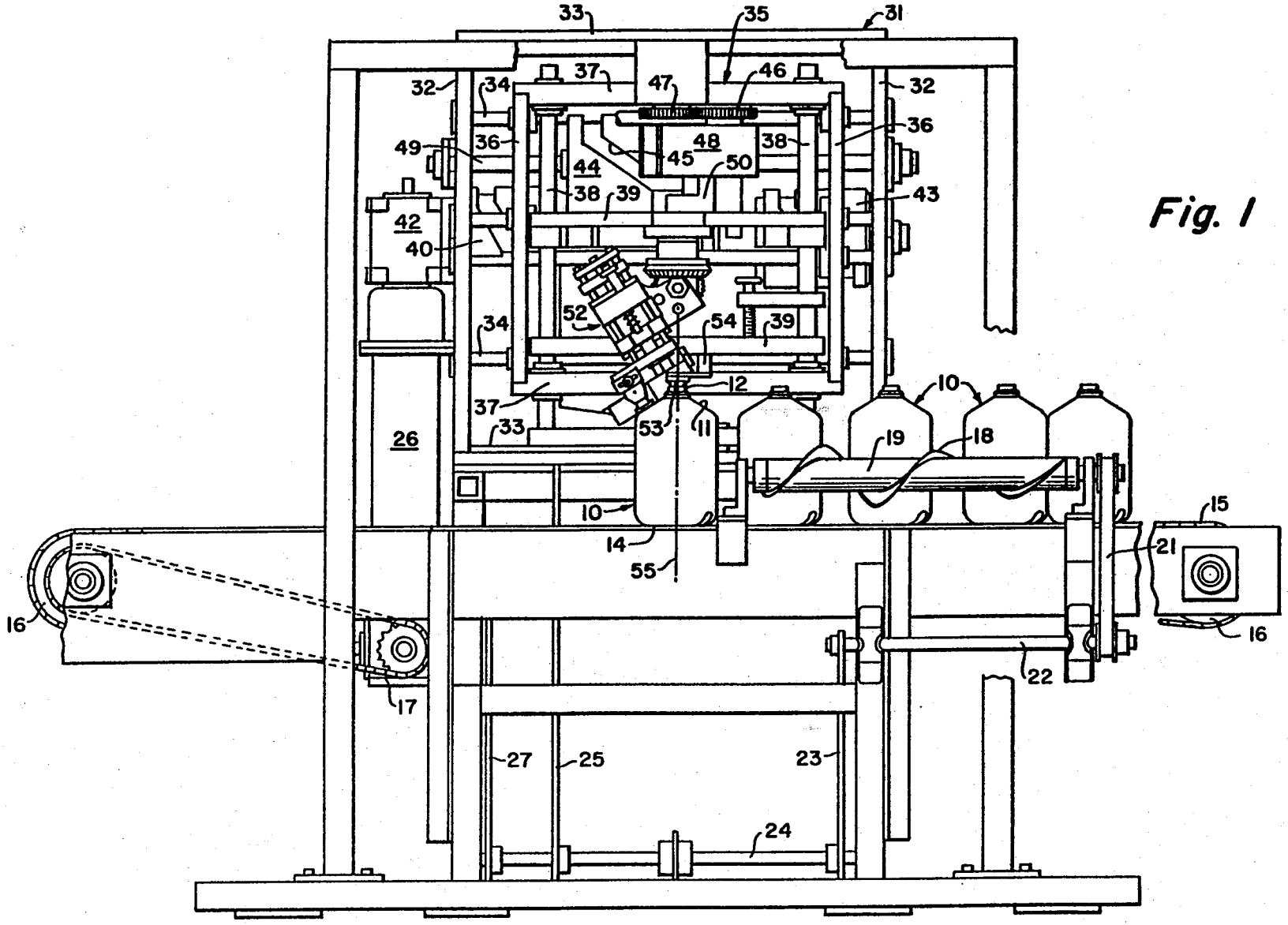
FIG. 1 is an overall elevational view of a decorating machine embodying the features of the present invention.
Figure 2:
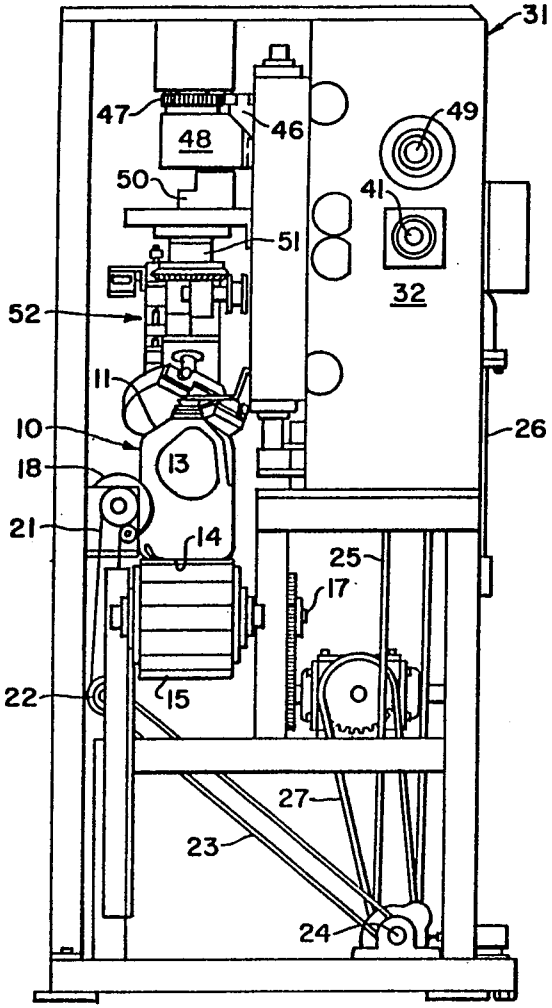
FIG. 2 is a side elevational view of the decorating machine shown in FIG. 1.

In FIGS. 1 and 2, there is illustrated the general layout of one form of apparatus according to the present invention which is also useful to carry out the method for decorating a workpiece. The workpiece shown in FIGS. 1–5 is a plastic container for milk or similar products. The container, a number of which is shown in FIG. 1 and identified by the reference numeral 10, has a generally square shape with rounded corners and an upper conical side wall surface 11. Surface 11 forms a transition wall with an annular neck portion 12 which has threads to receive a closure cap. As shown in FIG. 2, two side walls of the container form a hollowed-out area that defines a handle 13. A bottom wall 14 of the container is supported on flight attachments 15 secured at uniformly-spaced intervals to endless chains extending between sprockets 16, one of which is coupled to a gear drive 17. The plastic containers are separated from one another by a predetermined distance essentially defined by the pitch of a spirally-shaped feed attachment 18 on a shaft 19. The shaft 19 extends horizontally along one side of the conveyor at a location spaced above the flight attachments. Shaft 19 is supported by journals at its oppostie ends, one of which is extended and engaged with a pulley that is coupled by a belt 21 to a pulley on an idler shaft 22. Shaft 22 is driven by a chain 23 extending to a drive shaft 24 that is, in turn, connected by a chain 25 to a gear drive 26 including a motor. Chain 27 couples the drive shaft 24 to gear drive 17 for transmitting torque from drive 26 to the sprocket 16 of the conveyor. Only one drive 26 is used so that movement of the plastic containers by the conveyor is synchronous with operation of the decorating apparatus.

Figures 3, 8:
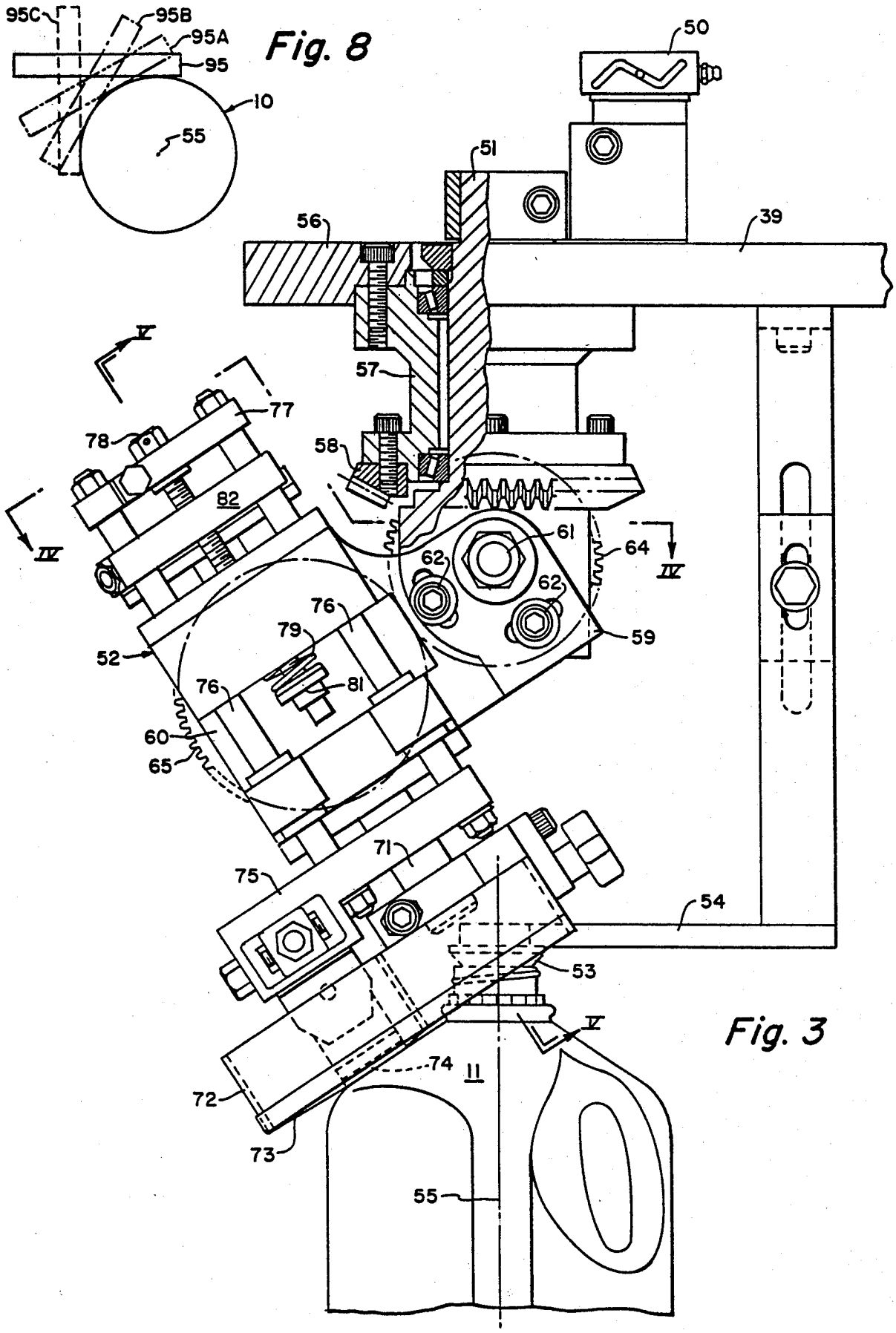
FIG. 3 is an enlarged fragmentary elevational view of the decorating apparatus shown in FIG. 1.
FIG. 8 is a schematic illustration of a further embodiment of the present invention for decorating a cylindrical surface of the workpiece.

In FIGS. 1 and 2, conveyor 15 extends along one side of a rectangular main carrier frame 31 including spaced-apart vertical side plates 32 joined together at their opposite ends by spacer plates 33. The frame 31 supports spaced-apart horizontal slide bars 34 which carry a horizontal slide frame 35. Frame 35 includes spaced-apart vertical side plates 36 joined together at their opposite ends by crossheads 37. The crossheads support vertical guide bars 38 engaged with a vertical slide frame 39. Frame 39 is reciprocated along bars 38 by a bellcrank, not shown, connected at one end to the frame 39 and rocked back and forth about a central pivot by the engagement of a cam follower on its free end with a lifting cam 40. The cam 40 is supported by a shaft 41 carried on the main frame 31 and driven by a gear reducer 42. The horizontal slide frame 35 is reciprocated back and forth on bars 34 by a cam follower extending from the frame into a cam track of a cam 43 which is secured to shaft 41 for rotation thereby and driven by gear reducer 42. A 360° rack drive cam 44 has a cam track 45 engaged with a follower extending from a gear rack carriage 46 supported for horizontal reciprocation and engagement with a gear 47 which is attached for rotating the vertical axis of a coupling member 48. A shaft 49 supports the cam 44 on main frame 31 while driven by a geared connection to drive shaft 41. Coupling member 48 has spaced-apart side plates forming a cavity that receives a crank arm 50 on a vertically-extending drive shaft 51 (FIG. 3). Crank arm 50 slides vertically in the pocket in coupling member 48 while maintaining a driving relation therewith. By this construction, a driving relation is maintained between the vertical slide frame 39 and drive shaft 51 while moving vertically relative to coupling member 48 and the horizontal slide frame which supports them.

As will be understood by those skilled in the art, the cams 40, 43 and 44 are rotated by the same drive 26 which rotates the sprocket 16 whereby the motion imparted to the horizontal and vertical slide frames displaces a decorating head assembly 52 in a timed relation with the movement of the plastic containers by the conveyor. The movement of horizontal slide frame 35 in a horizontal direction relative to main frame 31 throughout the actual decorating process is synchronous with movement of the containers. Prior to the decorating process, the vertical slide frame 39 is moved downwardly to a position where the decorating head assembly is in proper position for the printing process and simultaneously a chuck member 53 carried by the bracket 54 on the vertical slide frame engages with the plastic container under a sufficient force to hold it against rotation about a vertical support axis of the container. Such an axis is identified in FIGS. 1 and 3 by reference numeral 55.

Figure 4:
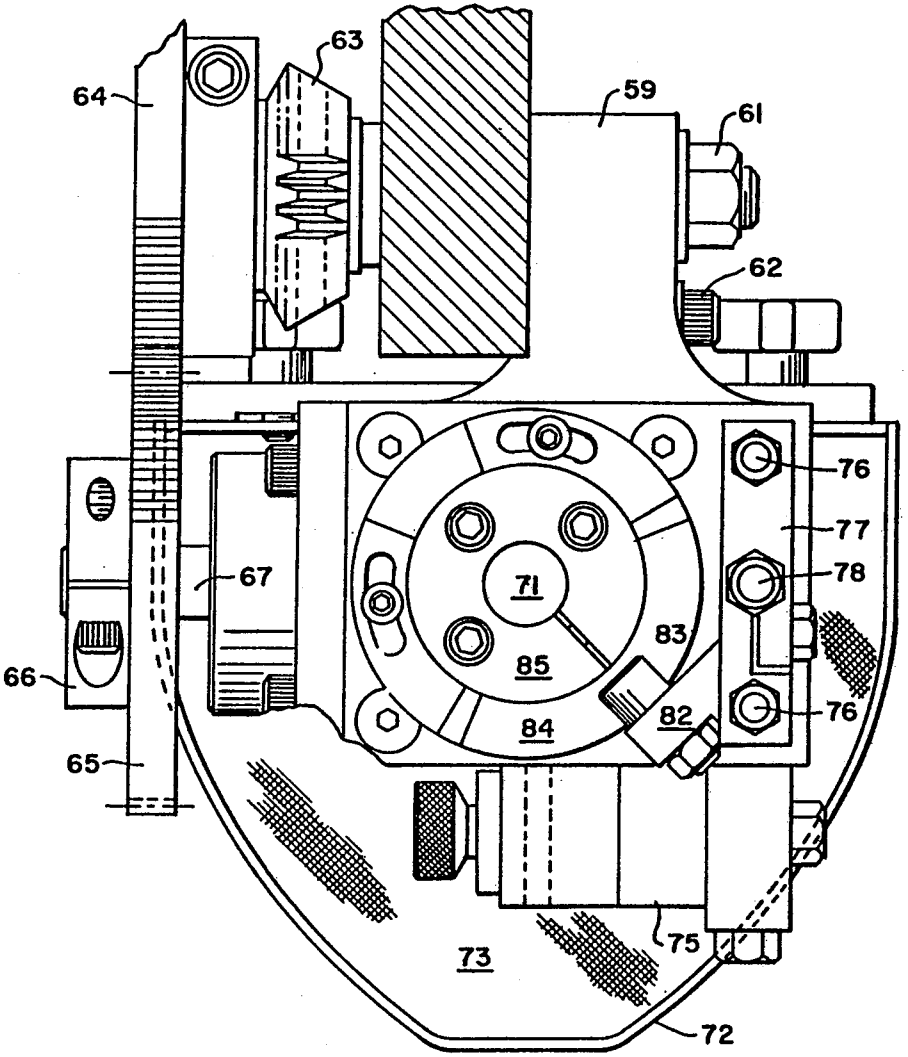
FIG. 4 is a sectional view taken along line IV—IV of FIG. 3.

FIGS. 3–5 illustrate the construction of the decorating head 52. Vertical slide frame 39 includes an outwardly-projecting support plate 56 that overlies containers when transported along the path of travel by the conveyor. The support plate has a bore through which drive shaft 51 extends. A support sleeve 57 is attached by threaded fasteners to support plate 56 and carries bearings that rotatably support shaft 51. A bevel gear 58 is secured by threaded fasteners to the lower end of sleeve 57. The lower end of drive shaft 51 has a machined flat face onto which there is attached a projecting wing 59 of a housing 60 by a nut and bolt assembly 61. Slotted openings in the housing wing receive other threaded fasteners 62 which secure the housing to the drive shaft when a desired angular relation is established. The head portion of nut and bolt assembly 61 has an extended length and it is machined to form an arbor for rotatably supporting a bevel gear 63 for rotation about a generally horizontal axis at right angles to the rotational axis of shaft 51 and in meshing engagement with bevel gear 58. A spur gear 64 is bolted to the flange of bevel gear 63 and meshes with a spur gear 65 that is attached by a flange 66 to a pivot shaft 67. As shown in FIG. 5, the pivot shaft 67 is supported by bearings in the housing 60 and carries a bevel gear 68 within a cavity of the housing. The bevel gear 68 meshes with a bevel gear 69 mounted on arbor 71 for rotation about an axis that forms an acute angle with support axis 55 when printing upon a conical surface of the container. Arbor 71 extends from the lower end of the housing where it supports a frame 72. Frame 72, part of the silk-screen assembly, is shaped in the form of a crescent. The frame 72 supports a screen 73 having openings defining a desired pattern which is to be printed on the container by forcing ink or other printing medium through the openings in the screen.

It can be seen from FIGS. 3 and 4 that rotation of shaft 51 rotates the silk screen about the axis of shaft 71 along the conical surface 11 of the container. The silk screen is positioned by the housing at a close, normally non-engaging relation with the surface 11. Line contact with surface 11 occurs by the pressure exerted on the screen from a squeegee 74 which engages the screen with line contact at its surface which is opposite the screen surface facing the container. The squeegee 74 is carried by a frame 75 that is, in turn, supported by guide rods 76 extending through openings in the housing to project from the opposite end thereof where a crosshead 77 joins the guide rods together. The rods transmit a biasing force to the squeegee from the relatively long threaded bolt 78 that extends through an opening in the housing. The lower end of the threaded bolt engages a spring 79 that is held captive on the bolt 78 against the housing by a fastener 81. To control movement of the squeegee for establishing line contact with the surface of the container, a bracket 82 extends from guide rods 76 and carries a follower roller 83 that rides along the surface of a rotary cam 84. An attachment plate assembly 85 secures the cam to a projecting end portion of shaft 71 which is opposite the squeegee and silk screen.

Rotation of the housing about the sleeve 57 brings about a rolling of the decorating screen along a tangential path about the conical surface of the container and concurrently therewith the squeegee is moved along an orbital path about the support axis 55. The squeegee is moved to form line contact with the surface of the container when a depressed area of the cam 84 underlies the follower 83 whereby push rods 76 are urged ,y spring 79 toward the container.

Figure 6:
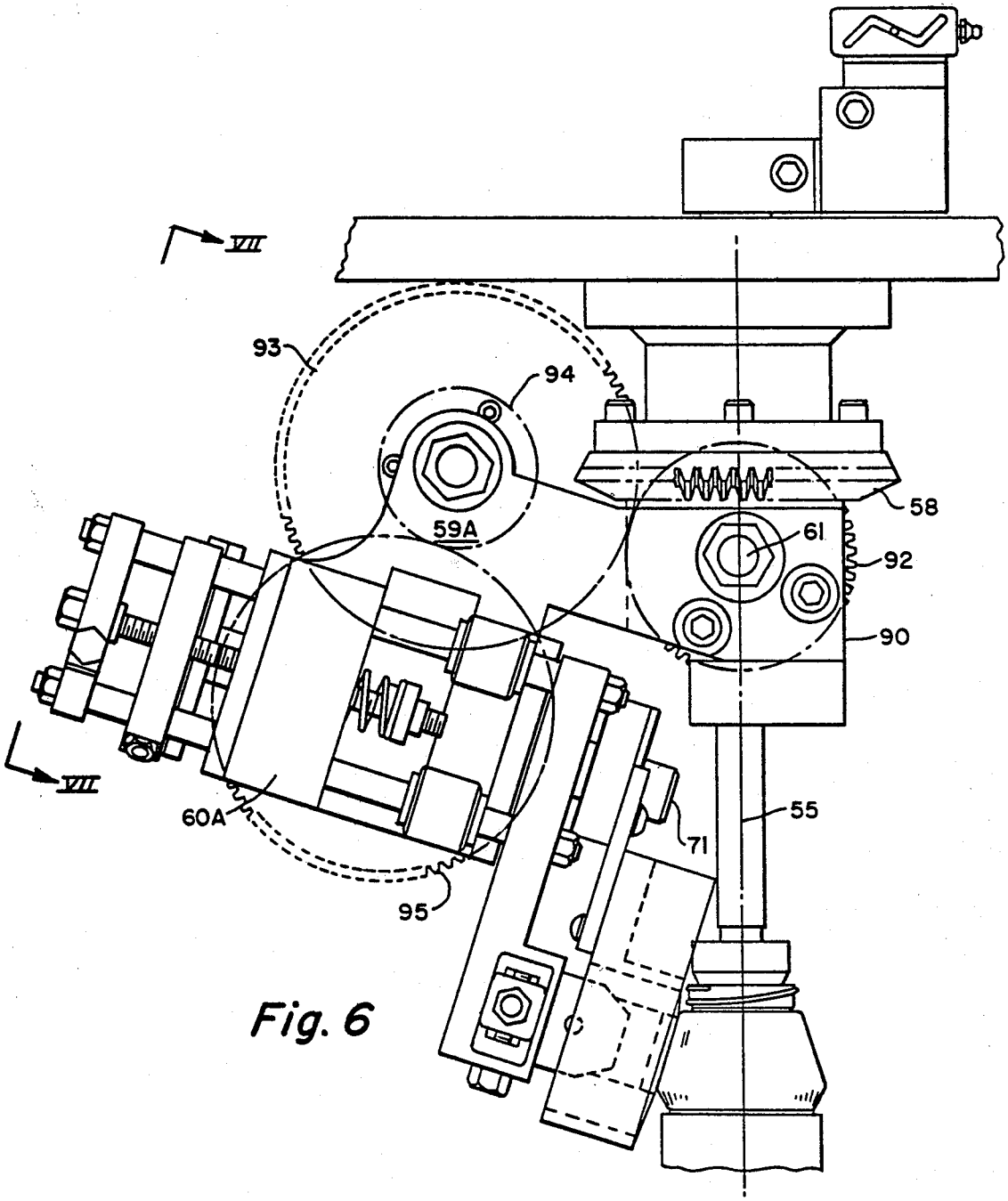
FIG. 6 is an enlarged fragmentary elevational view similar to FIG. 3 but illustrating a second embodiment of the printing apparatus according to the present invention.

FIGS. 6 and 7 illustrate a further embodiment of the present invention in which a larger angular relation exists between the rotational axis of the screen formed by shaft 71 for the rolling movement of the screen about a tangential path of the surface of a container. In this regard, housing 60A differs from housing 60 described hereinabove by the provision of a support flange extending from the housing wing. The flange which is identified in FIG. 6 by reference numeral 90 is used to support the housing by the use of the nut and bolt assembly 61 as previously described which also supports bevel gear 63 for meshing engagement with bevel gear 58. Bolted to bevel gear 63 is a spur gear 92 that meshes with an idler gear 93. An idler gear 94 is bolted to gear 93, both of which are supported for rotation on an arbor shaft carried by the projecting wing 59A of housing 60A. A drive gear 95 is mounted on shaft 67 by mounting collar 66. The use of idler gears 93 and 94 permits placing the housing at a greater angle, i.e., approaching 90°, between the support axis of the container and axis of rotation formed by shaft 71 for the rolling contact of the screen as described above. The rotational axis of shaft 71 is perpendicular to the conical surface of a workpiece. The operation of the squeegee is essentially the same as described previously and, therefore, the same reference numerals have been applied to corresponding parts in FIGS. 6 and 7. In view of the foregoing, it will now be apparent to those skilled in the art that a right-angle relationship between the support axis of a container and the pivot axis of the screen, while forming line contact with the surface of the article, can be readily accomplished by constructing the wing and arm portion of the housing so that the rotational axis of shaft 71 forms a right angle with the support axis 55. Proper driving relationship can be readily maintained with the idler gear 93 to bring about a rolling of the decorating screen about the surface of the article. As depicted schematically in FIG. 8, when the decorating screen 95 is rolled about a cylindrical surface of an article, it assumes positions 95A, 95B and fnally 95C. At the same time, the squeegee moves in an orbital path about the support axis 55 forcing printing medium through the openings in the screen and establishing line contact between the screen and the surface of a container.

Figure 9:
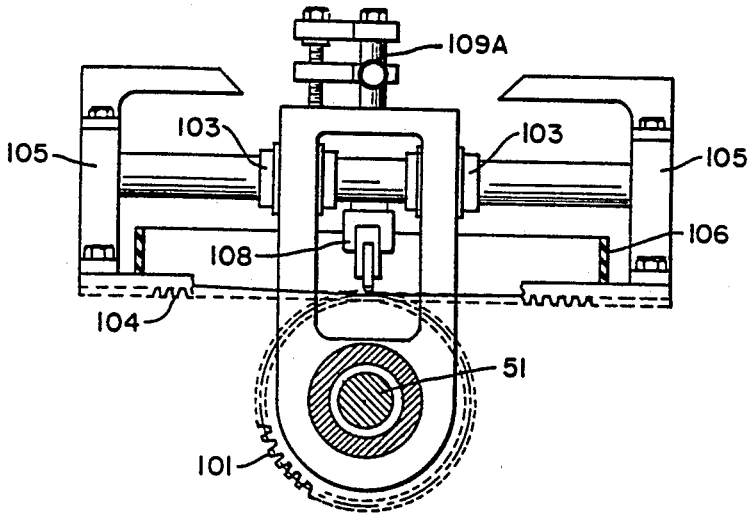
FIG. 9 is a plan view of apparatus to illustrate the embodiment of the present invention shown schematically in FIG. 8.
Figure 10:
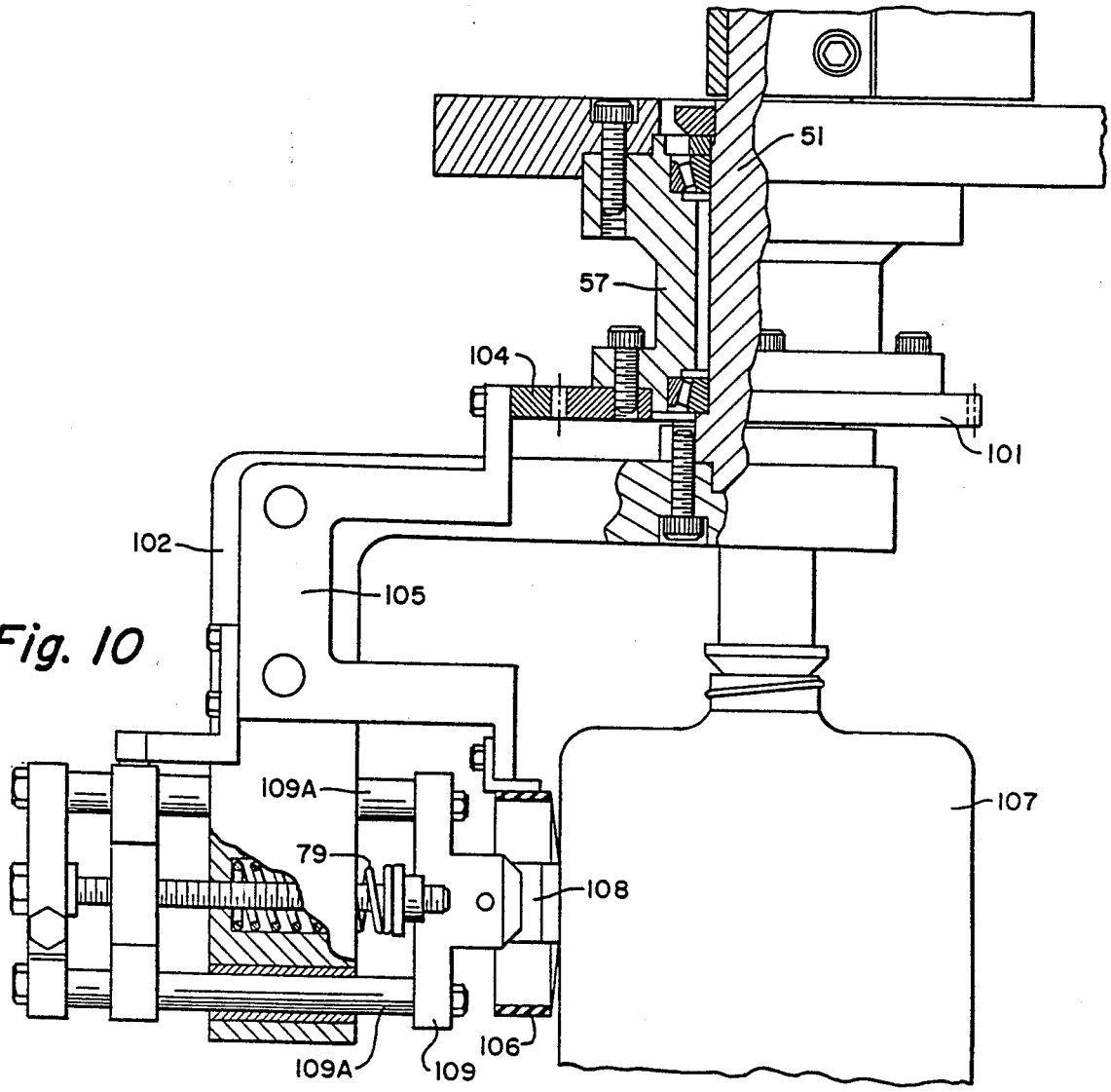
FIG. 10 is an elevational view, partly in section, of the apparatus shown in FIG. 9.

FIGS. 9 and 10 illustrate a simplified form of apparatus for printing in this manner on the cylindrical surface of a workpiece. A pinion gear 101 is mounted coaxially with the support axis 55 for the workpiece to the support sleeve 57 instead of the bevel gear 58 as described previously in regard to FIGS. 3 and 6. The same reference numeral identifies the same parts in FIGS. 9 and 10 as already described in regard to FIGS. 1-7. Drive shaft 51 is secured to a housing 102 that has a generally U-shaped configuration in the plan view shown in FIG. 9. Projecting leg portions of the housing 102 each includes a linear bearing 103 to slideably support an end portion of a rack 104. The rack is supported for reciprocating movement in the direction of its length such that the rack teeth mesh with the teeth of pinion gear 101. Secured to the central part of the rack is a frame 105 that carries a silk screen 106. In this aspect of the invention, the pitch diameter of the gear teeth of pinion gear 101 substantially corresponds to the diameter of the cylindrical surface of the workpiece 107 upon which printing is to be carried out. The frame 105 is attached to the rack so that the screen is closely spaced, e.g., by a slight airgap, from the cylindrical surface of the workpiece. A squeegee 108 is arranged so that its knife edge presses the screen against the surface of the workpiece along a line of contact therewith. The squeegee is carried by a frame 109 that is, in turn, supported by guide rods 109A extending through openings in the housing 102. A resilient force is provided by a spring 79 in the same arrangement of parts as described above in regard to FIG. 3. Thus, it can be seen that when printing on the cylindrical surface of a workpiece, a direct drive connection is established with the screen by the rack 104 and pinion gear 101. The pinion gear is mounted in a fixed manner concentric with the rotational axis of the squeegee and the rack is mounted to roll the screen surface about the surface of the workpiece.

Figure 11:
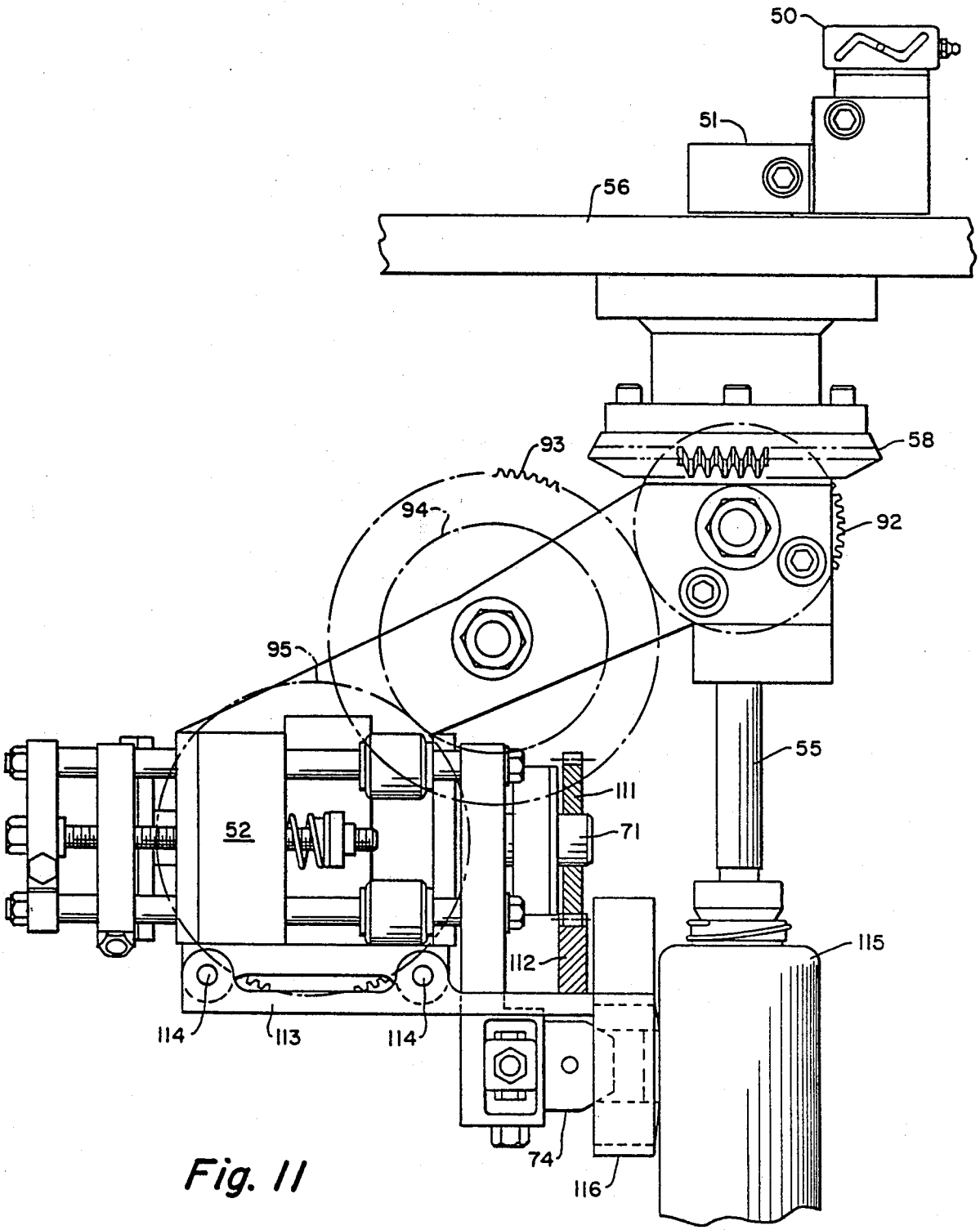
FIG. 11 is a view similar to FIG. 9 to illustrate a further embodiment of the present invention as shown schematically in FIG. 8.

In view of the foregoing, it will be understood by those skilled in the art that as a right-angle relationship is approached between the support axis of the workpiece and the axis about which the face surface of the silk screen is rotated, the radius of a conical surface becomes constant. For practical purposes, it is desirable to establish a maximum radius limit beyond which a conical surface should be treated as a cylindrical surface. At this transition limit, it is necessary to include in the drive train the addition of a gear to drive a rack. Such a gear can take the form of pinion gear 101 or, alternatively, as shown in a further embodiment by FIG. 11, a pinion gear 111 is driven by shaft 71 of housing 52 (FIGS. 3, 5 and 6) rather than by the drive train shown in FIGS. 9 and 10. Gear 111 meshes with rack 112 that carries a frame 113 supported by slide rods 114 on the housing 52 for reciprocating travel as it rolls about the cylindrical surface of a workpiece 115. A silk-screen assembly 116 is attached to the rack 112 or, if desired, to the frame 113. As described previously, the squeegee 74 is urged under a spring-biasing force against the silk-screen assembly 116 to establish line contact between the screen and the cylindrical surface of the workpiece. In the embodiment of FIG. 11, the housing 52 is rotated about support axis 55 of the workpiece and the train of gears 58 and 92-95 delivers torque to shaft 71.

Figure 12:
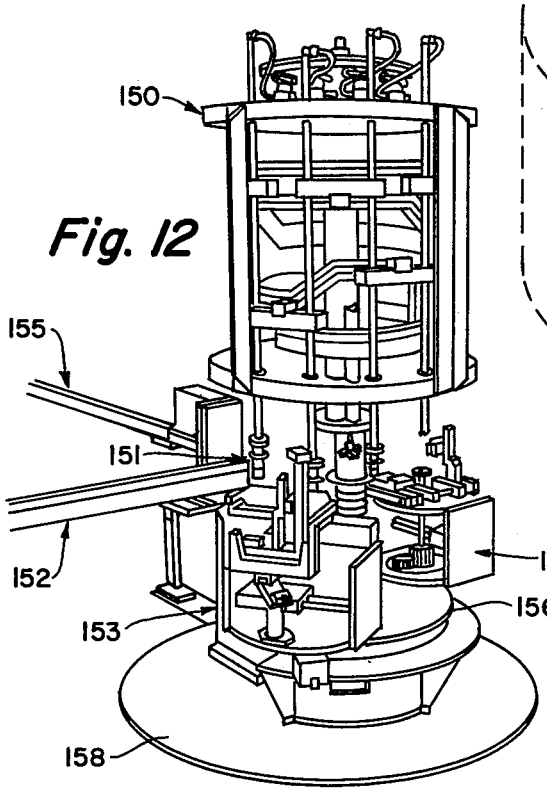
FIG. 12 is a front perspective view of the apparatus according to a further embodiment of the present invention for decorating a cylindrical surface of a workpiece.

The embodiment of the invention shown in FIG. 12 is particularly adapted for decorating a cylindrical surface of a workpiece with one or, if desired, two-color printing. It will be understood by those skilled in the art that the apparatus shown in FIG. 12 can be employed for printing upon a conical or other surface without departing from the spirit of the present invention. In FIG. 12, the apparatus generally comprises a carousal 150 that continuously rotates while a plurality of chuck members 151 on the carousal is moved vertically to engage and carry workpieces fed from an entry conveyor 152. Each chuck member 151 is lowered to engage the top of a workpiece such as a bottle whereupon the bottle is held by the chuck through the application of a vacuum and carried about a circular path of travel produced by continuous rotation of the carousal. When printing with a single color, the workpieces are carried to one of two decorating heads 153 and 154. When it is desired to decorate with two colors, a workpiece is delivered to each of the decorating heads in succession. After completion of the decorating process, all workpieces are carried by the chucks to a delivery conveyor 155. The decorating heads 153 and 154 are supported on a housing 156 at preselected and angularly-spaced locations on a diameter, the center of which intersects with an axis about which the housing is oscillated. Each decorating head is rotated about an axis corresponding to a support axis of the workpiece during decoration by the head. The decorating heads are rotated by an indexing drive located in a housing 156. An oscillating drive is below the housing 156 and supported on a foundation plate 158.

Figure 13:
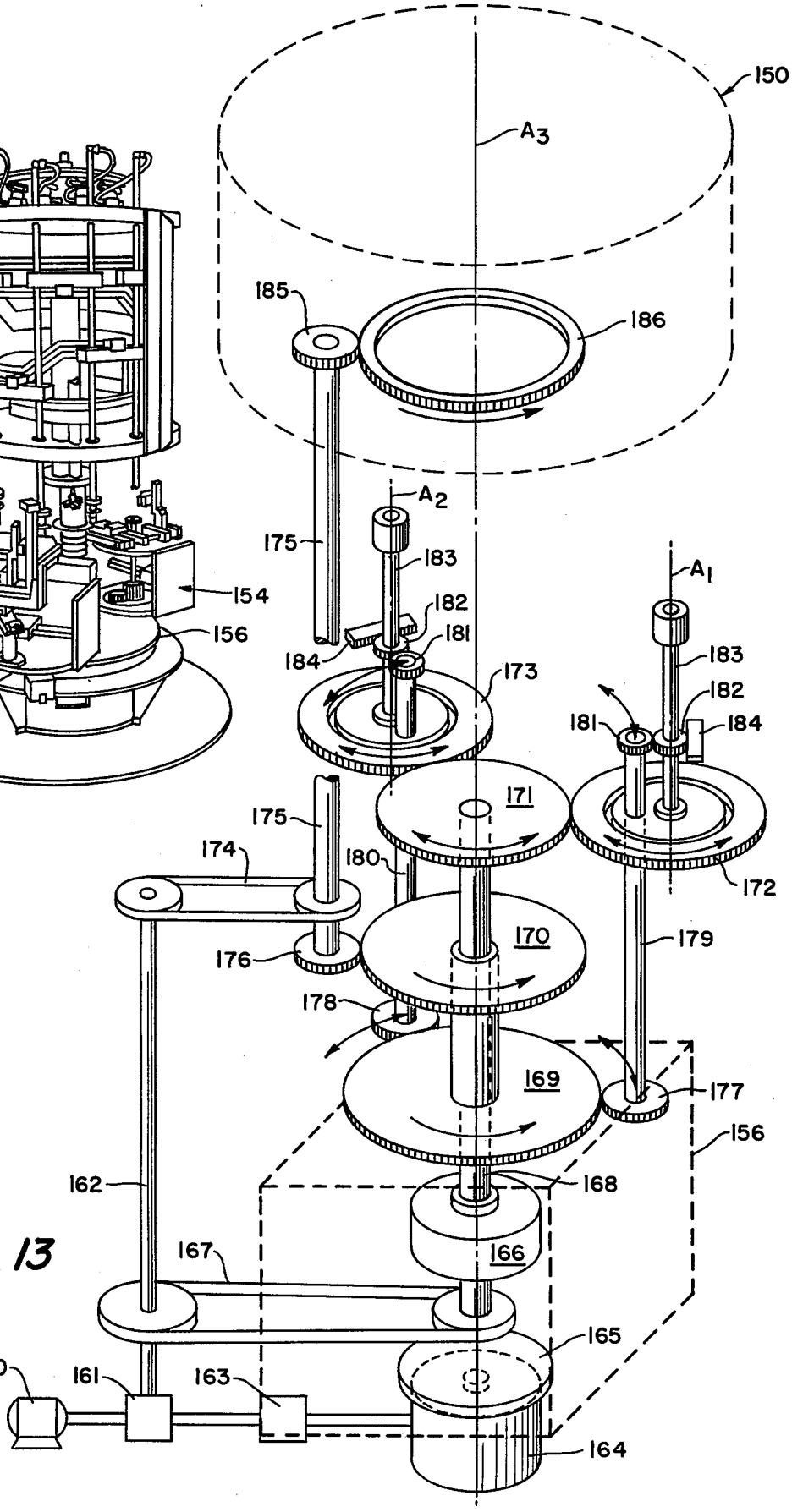
FIG. 13 is a schematic view of a drive system for the apparatus shown in FIG. 12.

The apparatus shown in FIG. 12 embodies a drive system schematically illustrated in FIG. 13 and includes a motor 160 having a drive output shaft coupled to the input shaft of a main speed reducer 161 which, in turn, has two output shafts, one of which drives a jackshaft 162 and the other of which is coupled to the input shaft of a speed reducer 163. The drive output from speed reducer 163 is coupled to the input shaft of an oscillating drive 164 having a drive output shaft 165. Typically, the oscillating drive rotates the output shaft 165 in one direction through a predetermined angular displacement, e.g., about 38° and then the shaft is rotated in the reverse direction to the original starting point. A drive of this type is well known in the art and one such drive is available from Commercial Cam Division, Emerson Electric Company, Wheeling, Ill., known as the 800-RD Series. The output shaft 165 is secured to and supported by housing 156, the latter being depicted schematically by broken lines in FIG. 13. Housing 156, in turn, supports an indexing drive 166 having a drive input shaft engaged with a pulley driven by a belt 167 from a pulley on the jackshaft 162. The indexing drive 166 may be constructed in a manner disclosed in U.S. Pat. No. 3,835,717 and includes a conjugate pair of endless internal cam surfaces secured to an input shaft which rotates at a constant angular velocity. Cam followers are supported by the output shaft and engage the cam surfaces which are generated to produce a predetermined angular displacement of the output shaft, e.g., 360° or greater, followed by rotation in the opposite direction to a start position. The output shaft of indexing drive 166 is identified by reference numeral 168. It is convenient to use the housing of the indexer to form a support arbor for an independently-rotatable pair of drive gears 169 and 170. An end portion of shaft 168 which projects above gears 169 and 170 is secured to a drive gear 171 for the decorating heads. Drive gear 171 meshes with two ring gears 172 and 173. The ring gears 172 and 173 are connected to rotate the housings of the decorating heads 153 and 154 about vertical workpiece-support axes $A_1$ and $A_2$. The continuous rotary motion imparted to jackshaft 162 via reducer 161 is transmitted through pulleys connected together by a belt 174 to a drive shaft 175. A pinion gear 176 is driven by shaft 175 and, in turn, drives gear 170. As will be explained in greater detail hereinafter, gear 170 is mechanically connected with gear 169 to rotate therewith and drive pinions 177 and 178 secured to shafts 179 and 180, respectively. Even though gear 169 rotates continuously in one direction, shafts 179 and 180 do not rotate continuously in one direction but undergo oscillatory rotation as the housing 156 on which the shafts are rotatably supported oscillates back and forth. The oscillatory motion is about the same axis as the axis $A_3$ of rotary movement by gears 169, 170 and 171 which are coaxially aligned. Shafts 179 and 180 extend the housings of the printing heads where each shaft is provided with a drive pinion 181 that meshes with an idler pinion 182 that can rotatably oscillate on a stationary support shaft 183. A rack gear 184 is driven by the motion imparted to pinion 182. The support shafts 183 define vertical axes corresponding to axes $A_1$ and $A_2$. Rack gear 184 is mechanically connected to a silkscreen assembly, not shown, situated to move in a tangential path about the surface of a workpiece with rolling contact therewith. A squeegee is supported on a decorating housing to orbit about the workpiece. The upper end of the shaft 175 engages a drive pinion 185 that, in turn, meshes with a ring gear 186 secured to the carousal 150 illustrated schematically by broken lines in FIG. 13.

Figure 14:
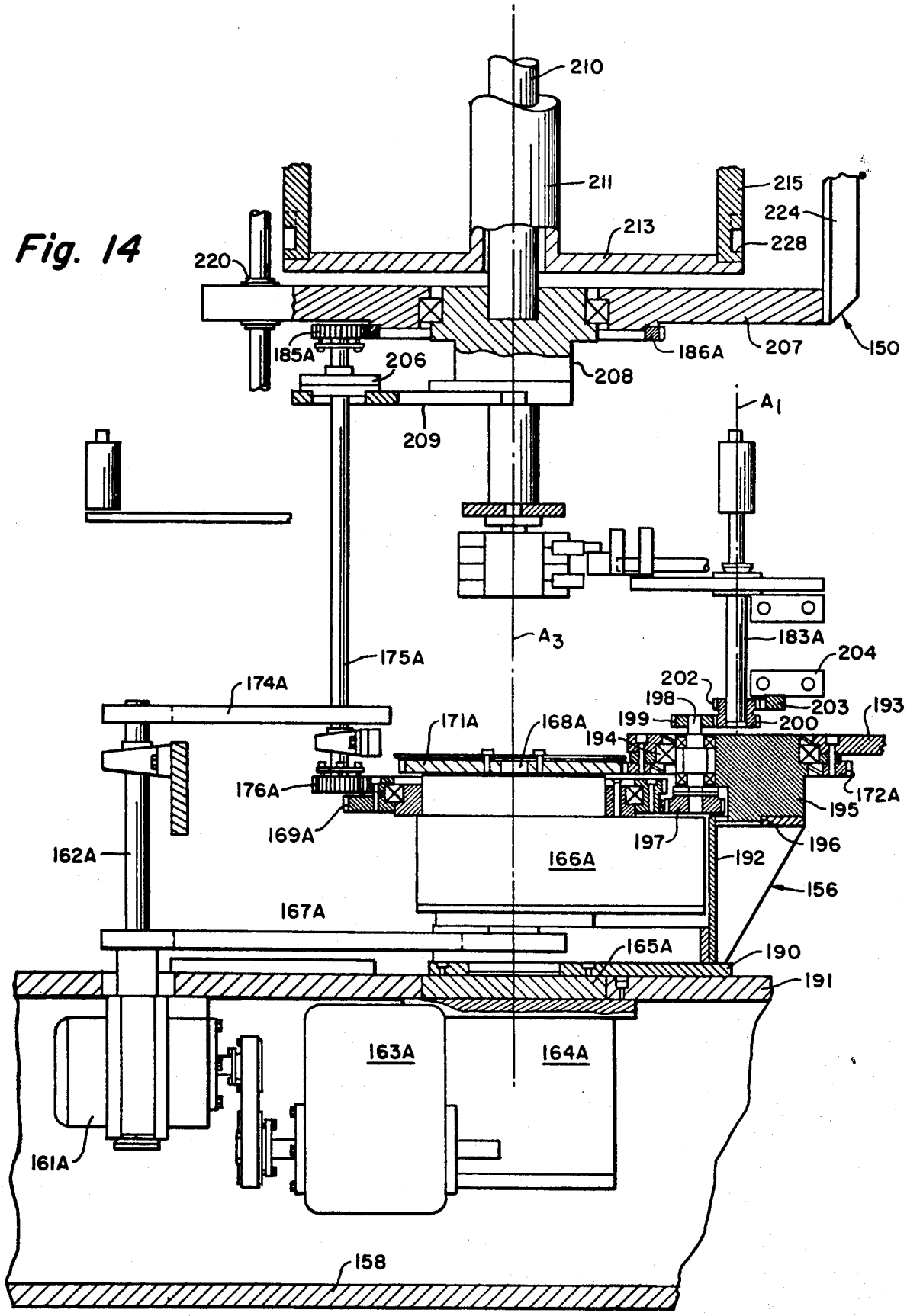
FIG. 14 is an elevational view, in section, through the apparatus shown in FIG. 12 to particularly illustrate the drive system.

FIG. 14 is a vertical section through the apparatus shown in FIG. 12 to illustrate a preferred embodiment of the drive system just described and schematically illustrated in FIG. 13. In FIG. 14, the suffix "A" has been included with reference numerals for parts described previously. In FIG. 14, main speed reducer 161A is driven by a motor, not shown, and has a drive output shaft connected by way of pulleys and a belt to speed reducer 163A which, in turn, has its drive output shaft connected to an oscillating drive 164A. The drive output shaft 165A has a flanged portion which is bolted to a base plate 190 forming part of housing 156. Immediately below plate 190 is a base plate 191 which is stationary and supported by upright members, not shown, above foundation plate 158. The housing 156 is supported via plate 190 on the output shaft 165A to oscillate back and forth to an angle of, for example, about 38° relative to plate 191. Housing 156 has upstanding side wall portions 192 that partly surround an indexing drive 166A. The indexing drive is driven by belt 167A from jackshaft 162A. The drive output shaft 168A of the indexer is bolted to drive gear 171A which, in turn, meshes with gear 172A that is, in turn, bolted to a rotary base plate 193. Gear 172A and base plate 193 are rotatably supported by a bearing 194 on a support block 195 having a pilot surface 196 on the bottom thereof to position and locate the support block of housing 156 so that gear 172A meshes properly with gear 171A and gear 169A properly meshes with a pinion gear 197. This arrangement of parts can be seen in greater detail in FIG. 15. Gear 196A is attached by bolts to gear 170A. Gear 170A is driven by a pinion 176A on shaft 175A by a belt 174A extending between the pulleys, one of which is secured to shaft 162A. Continuous rotary motion is imparted to gears 170A and 169A whereby the latter rotates pinion gear 197 on arbor shaft 198 that is rotatably supported by bearings in housing block 195. The arbor shaft 198 extends vertically and secured to its upper end is an idler gear 199 that meshes with a gear 200 that can freely rotate on the vertically-arranged workpiece-support shaft 183A. Gear 200 is integral with or secured to a gear 202 which meshes with teeth on rack 203 attached to a slide block 204 that is, in turn, supported for horizontal sliding movement on guide rods 205. The slide block 204 is connected to apparatus for moving the decorating screen so as to roll along a tangential path about a surface of a workpiece.

Figure 16:
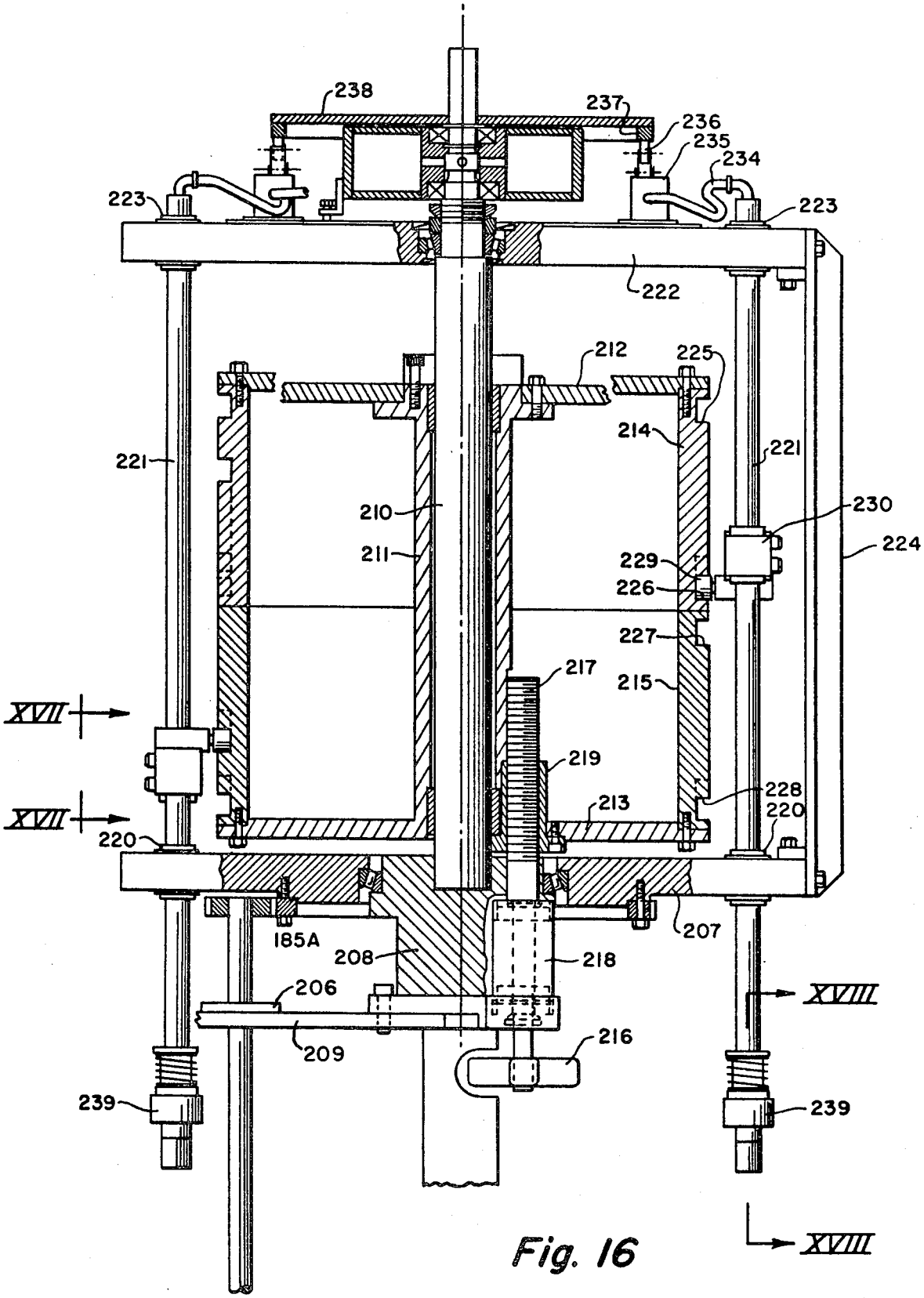
FIG. 16 is an elevational view, in section, through the carousal for feeding and delivering workpieces to decorating stations.

Before describing the details of each decorating head, as shown in FIG. 14, shaft 175A carries on its upper end a drive pinion 185A that meshes with a ring gear 186A bolted to an annular bottom plate 207 forming part of the carousal 150 as shown in FIGS. 14 and 16. The plate 207 is supported by a bearing to rotate on a stationary support 208 that includes a bearing support arm 209 for bearing 206. Support arms, not shown, extend from the top and bottom of support 208 to an upright column that engages the foundation plate 158 at the rear of the machine. Support 208 carries a vertically-extending shaft 210 that, in turn, supports a sleeve 211 having upper and lower end flanges 212 and 213, respectively, that support, in a superimposed relation, upper and lower cam drums 214 and 215, respectively. The elevation of the cam drums relative to the decorating heads is adjustable by rotating a handwheel 216 on the end of a vertically-arranged threaded shaft 217 carried by a bearing support 218 arranged in a bored opening provided in support 208. The threaded end of shaft 217 is received in a nut member 219 secured by fasteners to flange 213. Aside from adjustments to the elevation of the cam drums 214 and 215, the cam drums remain stationary during operation of the machine and plate 207 rotates continuously in one direction about the cam drums. Plate 207 has a plurality of bored openings spaced about a diameter thereof. Each bored opening is provided with a sleeve bearing 220 that, in turn, slideably receives a tubular shaft 221. There is a plurality of shafts 221, e.g., twelve, and each is passed through one of a plurality of openings located about a diameter in the plate 207 and in an upper support plate 222. A sleeve bearing 223 is interposed between the end portion of each shaft 221 and the upper support plate 222. As shown in FIG. 16, the upper support plate is supported by a bearing on shaft 210. The upper and lower plates 222 and 207 are interconnected by a spacer bar 224 to form a rigid structure that rotates about shaft 210 by torque applied to ring gear 186A.

Figure 17:
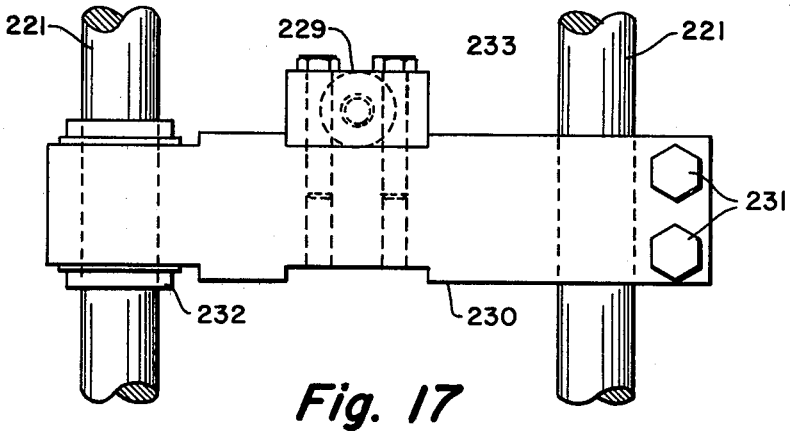
FIG. 17 is an enlarged view taken along line XVII—XVII of FIG. 16.

The shafts 221 are displaced vertically, up or down, at preestablished angular positions defined by one of a plurality of preselected cam tracks that are formed in cam drums 214 and 215. There are four endless cam tracks; two cam tracks 225 and 226 in the upper drum 214 and cam tracks 227 and 228 in the lower cam drum 215. One of the cam tracks is selected to receive a follower roller 229 extending horizontally from a slide block 230. The construction of the slide block is shown in FIG. 17. The slide block has an elongated rectangular shape with parallel, spaced-apart bored openings at opposite ends of the block. A saw cut is formed at one end of the block to a bored opening to form a clamp by provision of threaded fasteners 231 by which the block can be firmly clamped to a slide shaft 221. The bored opening at the opposite end of the slide block is provided with a bushing 232 to slideably guide the block on an immediately-adjacent one of the shafts 221. Between the two adjacent shafts 221, the slide block is provided with a notch to receive a mounting block 233 that, in turn, supports roller 229 while projecting into a selected cam track. It is to be understood that one slide block 230 is clamped to each shaft 221 and slideably guided by an adjacent one of the shafts 221. As shown in FIG. 16, the upper end of each shaft is constructed to threadedly receive a fitting that is, in turn, coupled by a flexible conduit 234 to a controller valve 235 which is mounted on plate 222 and provided with a movable actuating lever 236. Each shaft 221 is connected to a separate valve 235. The valves rotate with plate 222 whereby lever 236 moves along a stationary cam surface on cam plate 237. Cam plate 237 is supported by a cover plate 238 that is, in turn, supported by shaft 210. Each valve 235 is connected to a supply of vacuum so that as each lever for a valve is moved to an open position by cam plate 237, vacuum is applied to shaft 221 coupled thereto. The shafts have an internal passageway and the lower end of each shaft 221 is provided with a chuck incorporating a valve system to apply vacuum to the interior of a workpiece to retain it against the vacuum chuck during movement between the entry conveyor and the delivery conveyor as previously described.

Figure 18:
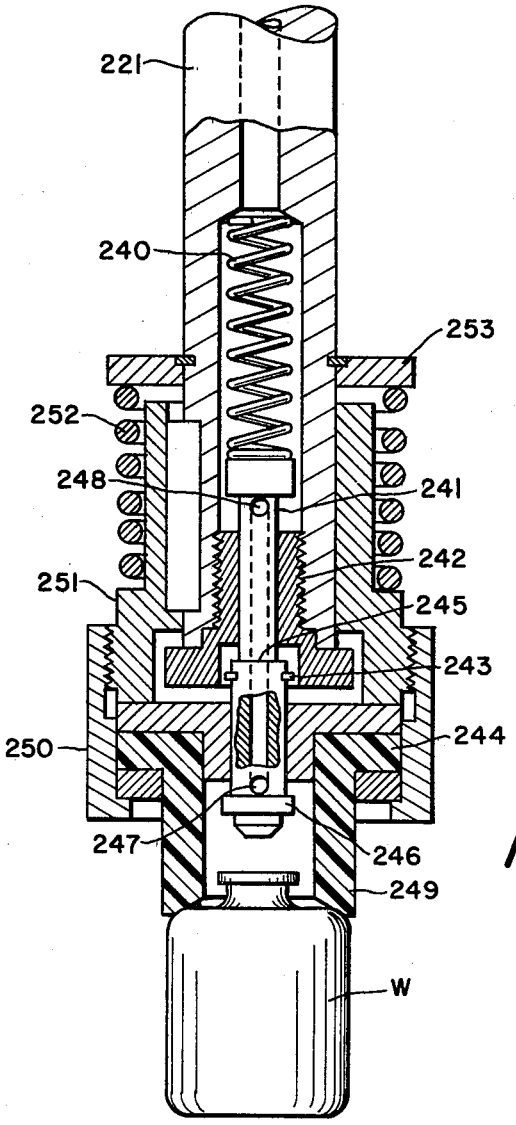
FIG. 18 is an enlarged sectional view taken along line XVIII—XVIII of FIG. 16.

The details of the construction of the vacuum chuck assembly, identified by reference numeral 239, are shown in FIG. 18. The lower end of shaft 221 is machined to form an enlarged cavity into which there is positioned a spring 240 such that one end of the spring seats against a shoulder surface in the cavity while the other end of the spring engages an enlarged head portion of a valve plunger 241. The plunger is guided in a retainer 242 that is threaded into the end of shaft 221. At its lower end below the shaft 221, an enlarged collar of the retainer 242 forms a cavity wherein a snap ring 243 can pass while engaged on a lower portion of the plunger 241. The snap ring will drop into engagement with the upper surface of a support fixture 244 and thereby prevent dislodgement of the lower section of the plunger when the plunger is comprised of two parts. For ease of construction and assembly, it is preferred to construct the plunger 241 from an upper part and a lower part abutted together at 245. The lower part of the plunger has a collar 246 spaced below an opening 247 that communicates by an axially-extending opening with an opening 248 for conducting vacuum in the internal passageway of shaft 221 to the space enclosed in part by a tubular wall of a workpiece-support fixture 249 which is made of yieldable elastic material so that the lower end thereof can move into sealing engagement with a workpiece W. A flange on the upper portion of the workpiece-support fixture 249 is clamped against support fixture 244 through an intermediate ring by a collar 250 that threadedly engages a guide tube 251. The guide tube has an internal diameter substantially corresponding to the outside diameter of shaft 221 to slide therealong. The shaft 221 is moved downwardly so that the lower end of the workpiece-support fixture 249 engages the workpiece W whereupon continued movement of the shaft 221 moves the fixture against the force of a spring 252 that extends between the guide tube 251 and a retainer collar 253. This downward force presses the fixture 249 tightly into engagement with the workpiece forming a vacuum-tight seal therewith. Vacuum is delivered from the center of shaft 221 through the plunger 241 to the top shoulder or crown of the workpiece. Sufficient vacuum is applied to hold the workpiece under the weight thereof. Collar 246 may engage the workpiece and move the plunger 241 against the force of spring 240 so that openings 247 and 248 are not blocked by retainer 242 and support fixture 244. To prevent unwanted leakage of vacuum during the time that when a workpiece is not engaged with a chuck, spring 240 forces plunger 241 downwardly so that opening 248 is situated in the retainer 242, thus interrupting communication with the vacuum existing in the shaft thereabove.

Figure 19:
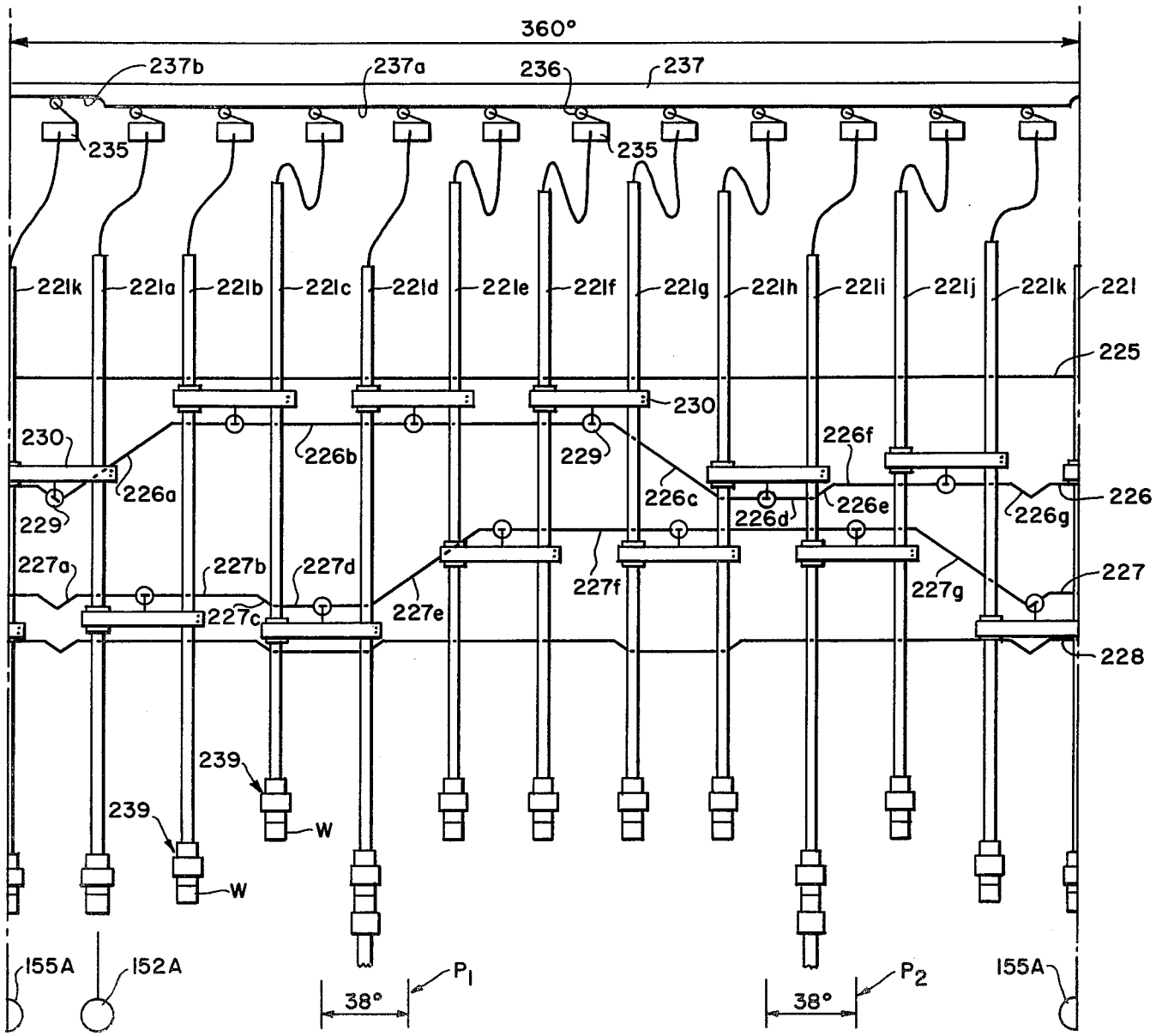
FIG. 19 is a development view laying out the cam track and workpiece-carrying members of the carousal to illustrate the operation thereof for decorating workpieces at each of two decorating stations.

FIG. 19 schematically illustrates the operation of the carousal for carrying workpieces W from the feed conveyor to the delivery conveyor through intermediate positions during which decoration is applied to the surface of the workpiece. In FIG. 19, the cam tracks 225–228 as well as cam track 237 are shown schematically. In the embodiment of the invention shown in FIG. 12, the carousal is provided with twelve shafts 221 which are identified in FIG. 19 by reference numerals 221*a*–221l. Each of these shafts carries a workpiece to one of two printing stations P1, P2. The entry conveyor shown in FIG. 12 is identified in FIG. 19 by reference numeral 152A and the delivery conveyor is identified in FIG. 19 by reference numeral 155A. Successively-arranged shafts 221 are controlled alternately by cam tracks 226 and 227 when printing at every station P1, P2 with only one color. Shaft 221*a*, in the position shown in FIG. 19, is positioned by the follower roller 229 which controls its movement by reason of the clamp attachment of block 230 to shaft 221*a* for the follower roller. The follower roller is at a low point in the cam tracks at the entrance to an upwardly-sloping cam section 226*a*. At the position shown in FIG. 19, shaft 221*a* is engaged with a workpiece on the entry conveyor whereby the workpiece is held to the chuck by vacuum which is applied through the chuck as previously described. The vacuum is turned ON to shaft 221*a* by the position of an associated controller 235 in relation to cam track 237. In other words, cam track 237 has a cam surface 237*a* which depresses the actuator for the controller to apply vacuum to shaft 221*a*. As the shafts rotate about the cams, the cam follower for shaft 221*a* climbs up cam section 226*a*, thereby lifting the workpiece from the entry conveyor 152A to a predetermined elevation that is established when the cam follower reaches cam section 226*b*. The workpiece is then held at this elevation for a period of time during which it passes over printing station P1 and approaches printing station P2 which is angularly displaced from station P1. At this point, the cam follower for shaft 221*a* moves to a descending cam section 226*c*, thus lowering the workpiece until the cam follower reaches cam section 226*d* whereupon the workpiece is set onto a bottom support on a decorating head and held there against rotation for a period of angular movement, e.g., 38° during which the cam follower for shaft 221*a* moves along a horizontal cam section 226*d*. The printing operation will be complete by the time the cam follower reaches cam section 226*e* which functions to lift shaft 221*a* vertically from the decorating station P2 to an elevation established by movement of the cam follower on cam section 226*f*. As the workpiece is carried by shaft 221*a* during movement of the associated cam follower along cam section 226*f*, it is held at an elevation so that it can be deposited on a delivery conveyor 155A as the follower enters and passes along cam section 226*g*. At the lower end of cam section 226*g*, the associated vacuum controller will move to a cam section 237*b* which releases vacuum from the shaft 221*a* and thereby permits the workpiece to separate from the vacuum chuck.

In a similar way, it can be seen that shaft 221*b* which leads shaft 221*a* in relation to the rotation about the cams will receive a workpiece when the shaft's follower is at the entrance to the cam section 227*a* from the entry conveyor 152A. The cam follower for shaft 221*b* then moves along cam section 227*a*, thus raising the shaft and workpiece carried thereby to an elevation established by cam section 227*b*. The workpiece which is to be decorated at station P1 is lowered onto a support as the cam follower passes along cam section 227*c*, thus lowering the shaft 221*b* to an elevation where the workpiece engages a bottom support on a decorating head. The workpiece undergoes decoration at station P1 during 38° of rotation which occurs while the cam follower moves along cam section 227*d*. After decoration, the workpiece is lifted from the support at station P1 by movement of the cam follower along cam section 227*e*, thereby lifting the carrier shaft to an elevation established by cam section 227*f*. At this elevation, the workpiece is carried beyond the printing station P2 to an angular position where the cam follower passes downwardly along cam section 227*g* to deposit the workpiece on the delivery conveyor 155A. As this occurs, the controller 235 is deenergized by cam section 237*b*. Shaft 221*c* follows the same course of travel as shaft 221*a* and shaft 221*d* follows the same course of travel as shaft 221*b*. Thus, it can be seen that alternating shafts 221*a*–221*l* carry workpieces alternately to printing stations P1 and P2.

Figure 20:
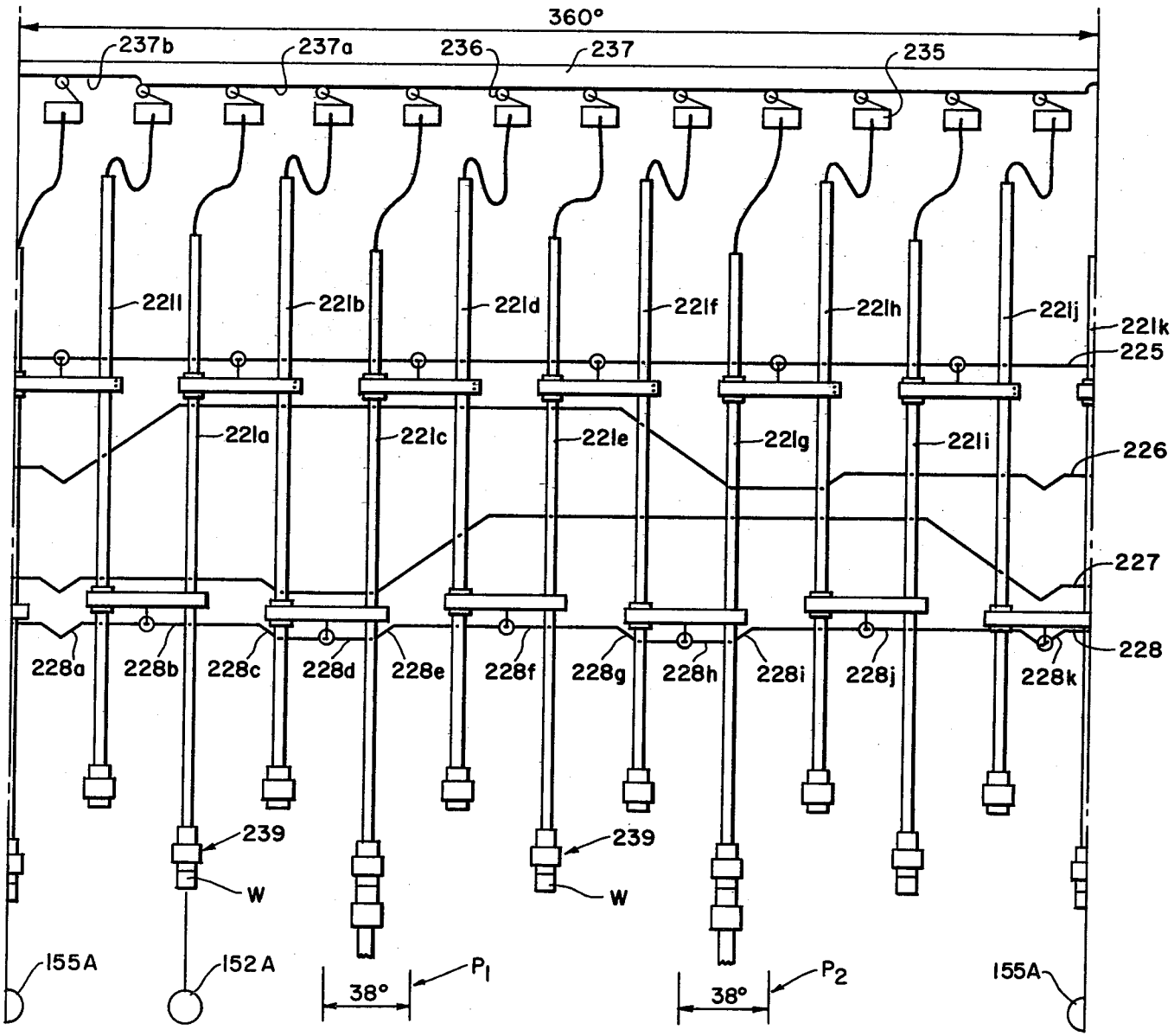
FIG. 20 is a view similar to FIG. 19 but illustrating the operation of the carousal for carrying workpieces to each of two decorating stations for applying a two-color decoration to each workpiece.

For decorating a workpiece with two colors, each station P1 and P2 is equipped to apply a different color decoration. As shown in FIG. 20, cam tracks 226 and 227 are not used during this mode of operation but, instead, the cam followers for shafts 221*a, c, e, g, i* and *k* are positioned in cam track 225 and the remaining cam followers are positioned in cam track 228 which holds alternating ones of the shafts 221 at an inoperative location while the remaining shafts carry workpieces to both decorating stations P1 and P2. Printing station P2 is repositioned at a closer angular relation from station P1 when decorating with two colors as compared with decorating with only one color. The purpose of such repositioning is due to the fact that the decorating station P2 when decorating with one color is not angularly situated to receive a workpiece carried by a shaft that has moved to decorating station P1. It can be seen from FIG. 20 that each of the followers which engage cam track 225 hold the shafts 221*b*, 221*d*, 221*f*, 221*h*, 221*j* and 221*l* at a constant elevation that does not change as they are rotated by the carousal. The remaining shafts are controlled by followers that pass along cam track 228. Each of these shafts follows the same path. Shaft 221*a* engages a workpiece at the entry conveyor 152A whereupon vacuum is applied to hold the workpiece to the chuck by the operation of a controller associated with shaft 221*a* by the cam section 237*a*. Vacuum which is applied to the shaft is transferred to the workpiece by the operation of a chuck so that the workpieces carried by the shaft is lifted from the entry conveyor as the cam follower passes along cam track section 228*a*, thereby lifting the workpiece to an elevation established by cam track section 228*b*.

The workpiece is held at this elevation until the follower roller reaches the cam track section 228*c* whereupon the workpiece is lowered onto the support surface at decorating station P1 which occurs as the follower reaches cam track section 228*d*. The workpiece is held against rotation at decorating station P1 throughout the printing operation during which the cam follower passes along track section 228*d*. Thereafter, the workpiece is lifted from the support surface as the follower passes along cam track section 228*e*. The workpiece is held at an elevation established by cam track section 228*f* for a period of time until the workpiece is again lowered by cam track section 228*g* onto a support surface at decorating station P2 where it is held against rotation during the decorating operation. The decorating operation occurs as the cam follower passes along cam track section 228*h*. After decoration, the follower roller passes along cam track section 228*i*, thereby lifting the workpiece from the decorating station P2 to an elevation established by cam track section 228*j*. The workpiece is then held at this elevation while carried to a discharge station where it is lowered by cam track section 228*k*. Vacuum is then disconnected from the support shaft 221*a* by the operation of the controller 235 associated therewith and the cam track section 237*b*.

Figure 15:
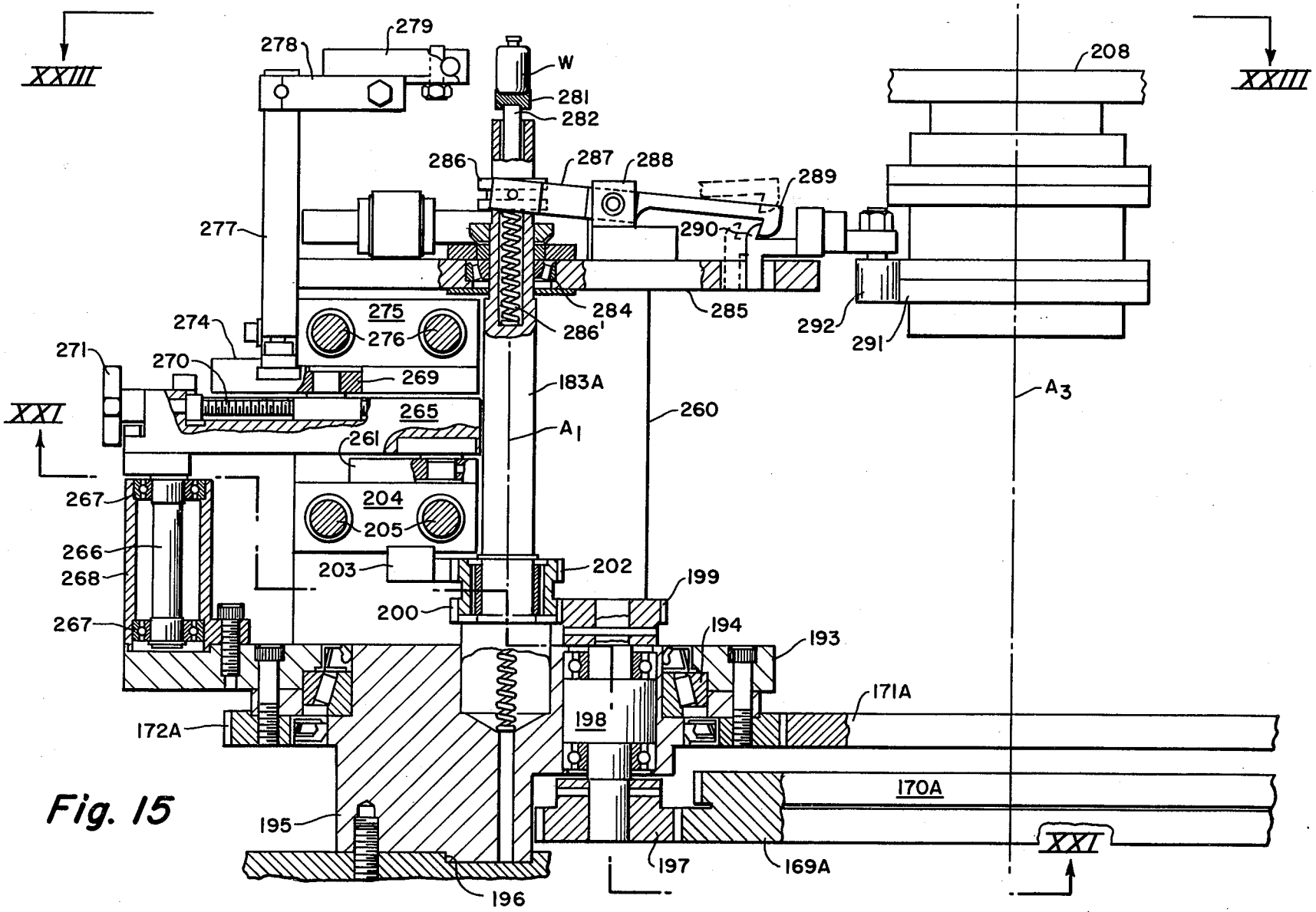
FIG. 15 is an enlarged view to better illustrate part of the drive system shown in FIG. 14.
Figure 21:
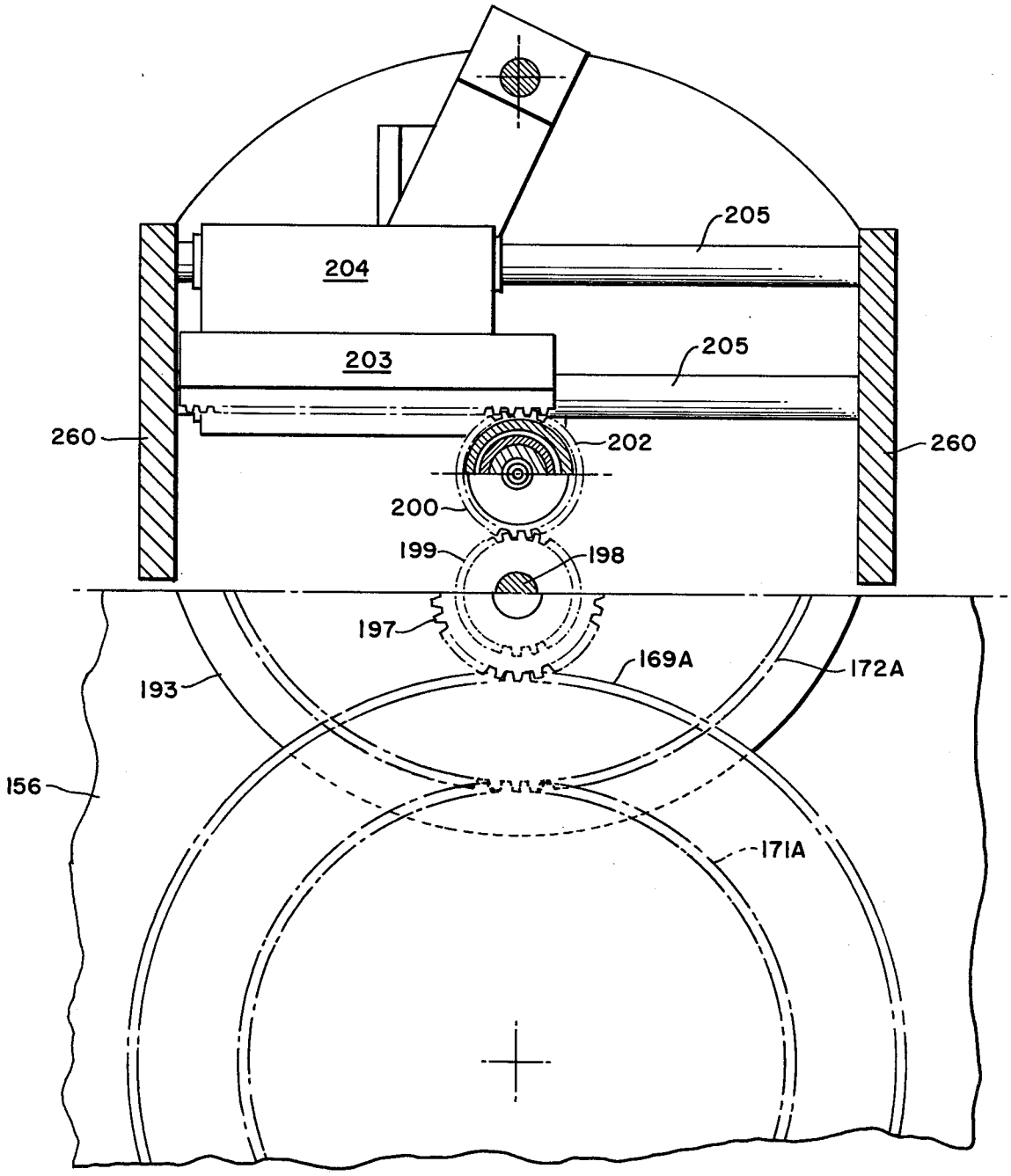
FIG. 21 is a sectional view taken along line XXI—XXI of FIG. 15.

With reference again to FIG. 15, each decorating head 153 and 154 (FIG. 12) is carried back and forth through a predetermined angle, e.g., 38° by the oscillating motion which is imparted by the oscillator 164A to the housing 156 upon which the decorating heads are supported. This oscillating portion of the decorating head is combined with rotary motion of each decorating head relative to housing 156 through an angle sufficient to apply decoration to a desired circumferential area of the workpiece. During the actual decorating operation, in accordance with the present invention, the printing screen is reciprocated to roll about the outer surface of the workpiece while a squeegee is orbited about the workpiece to force printing medium through open spaces in the screen. As previously described, gear 202 meshes with teeth on rack 203 that is attached to slide block 204 which is, in turn, supported for horizontal sliding movement on guide rods 205. Block 204 is displaced back and forth along the guide rods 205 as shown in FIGS. 15 and 21. The guide rods 205 extend between spaced-apart side plates 260 that extend from base plate 193. During decoration, the base plate 193 is carried with housing 156 at a speed such that no relative rotation occurs between gear 169A and gear 199. At the same time, gear 171A rotates base plate 193, causing gears 197 and 202 to rotate and displace rack 203 along rods 205. Rack 203 travels in the reverse direction along rods 205 due to relative rotation between gear 169A and gear 199 as the base plate is carried with the housing 156 by the oscillating drive 169A.

Figure 22:
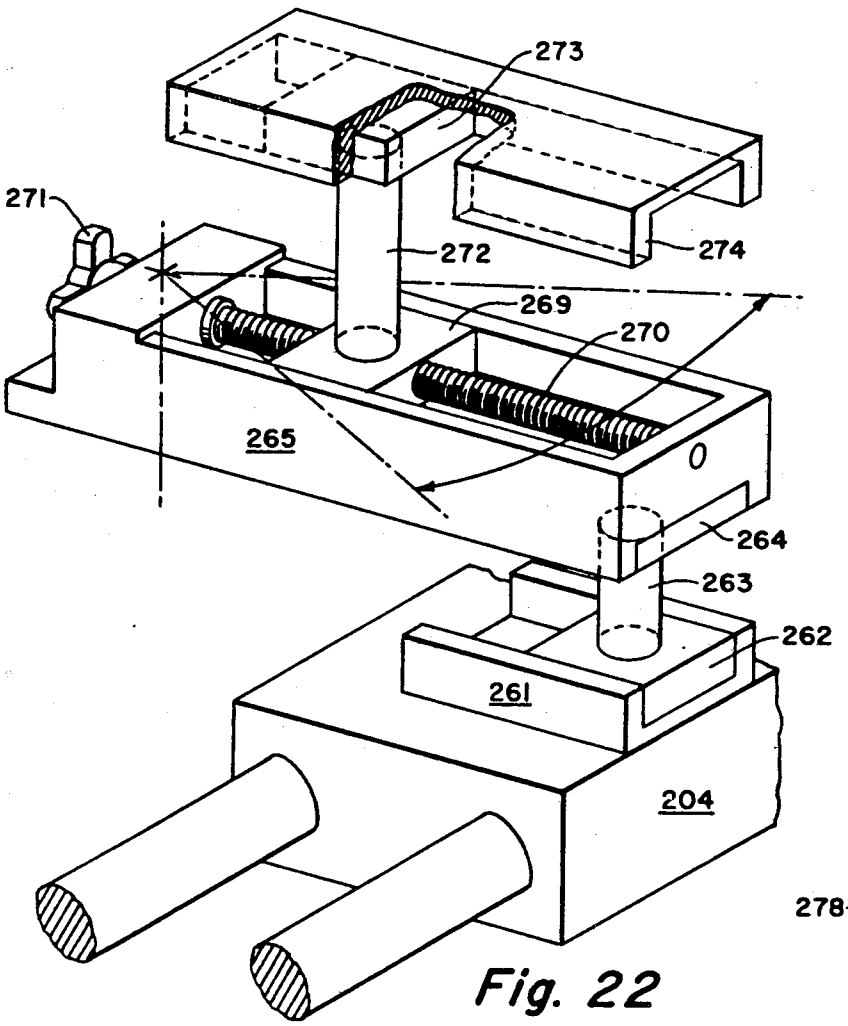
FIG. 22 is an isometric view illustrating the mechanical system for selectively varying the movement of a printing screen about the surface of a workpiece with zero relative motion therebetween.

As shown in FIGS. 15 and 22, block 204 supports a U-shaped slide channel 261 on the top surface thereof. A slide block 262 is dimensioned to move back and forth in the channel 261. The slide block 262 carries a pivot shaft 263 that extends upwardly to a pivot block 264 that is secured within a recess formed in the undersurface of an oscillating arm 265. Arm 265 is supported by a downwardly-extending pivot shaft 266. Shaft 266 is supported by upper and lower bearings 267 in a tubular housing 268 that is, in turn, attached by bolts to base plate 193. The oscillating arm 265 has a hollowed-out slide cavity into which there is received an adjusting block 269 that can slide back and forth in the cavity in the direction of the extended length of the oscillating arm. Block 269 has a threaded opening into which a threaded shaft 270 is received. Shaft 270 is supported by end walls at the opposite ends of the arm 265 so that rotation of the shaft 270 by torque applied to a handwheel 271 moves the block 269 back and forth in the cavity in the arm. Extending upwardly from block 269 is a pivot shaft 272 having its upper end received in a slide block 273 which can, in turn, slide back and forth in a slide channel 274. Channel 274 is secured to the undersurface of a slide block 275. Slide block 275 is supported for horizontal sliding movement on guide rods 276 that extend between and are supported by side plates 260 in a generally parallel and overlying relation with guide rods 205.

It will be seen from FIGS. 15 and 22 that block 204 which is driven back and forth on rods 205 by rack 203 oscillates arm 265 about its support shaft 206. As arm 265 moves back and forth, shaft 272 also moves back and forth by reason of its support by block 269 in the cavity of the support arm. The angular displacement of shaft 272 by arm 265 can be selectively varied by changing the position of block 269 along the extended length of the arm. The purpose of this adjustment is to match, with zero relative movement, the rolling of a decorating screen about the surface of a workpiece. This is particularly important for setting up the operation for decorating a quantity of workpieces that have a diameter that is different from the workpieces that have been previously decorated.

Figure 23:
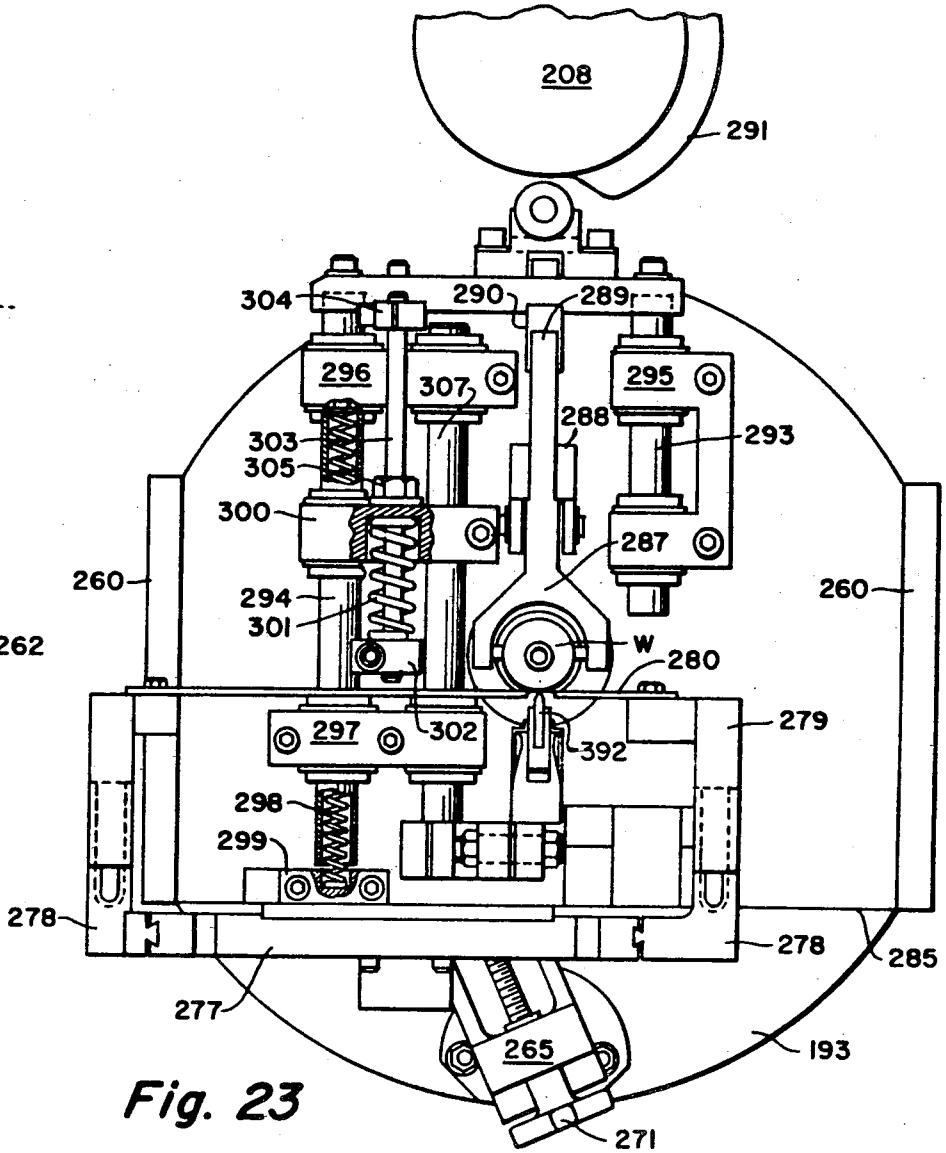
FIG. 23 is a plan view of a decorating head taken along line XXIII—XXIII of FIG. 15.

Block 275 supports carrier bars 277 as shown in FIGS. 15 and 23. The carrier bars have vertically-arranged dovetail-shaped support surfaces that receive laterally-extending support arms 278. A frame of silk-screen printing assembly 279 is releasably secured to the support arms 278 so that a screen member 280 of the assembly lies in a vertical plane or angularly thereto that is preferably spaced a slight distance from the surface of workpiece W when supported on a base 281. As shown in FIGS. 15 and 23, the base 281 has a downwardly-extending plunger 282 received in a support shaft 183A that is stationary and supported by bearings 284 which permit top support plate 285 to rotate. Plate 285 extends between and is supported by side plates 260. A spring 286, is located in shaft 183A and extends between the bottom of plunger 282 and a support surface in shaft 183A.

Referring again to FIGS. 15 and 23, the workpiece W is carried to the decorating station by the support tubes as previously described. At the decorating station, the workpiece is pressed downwardly by the support shafts 221 on base 281, thereby also displacing plunger 282 which, in turn, is engaged with a bushing 286 by a pin extending through a slot, not shown, in the side wall of shaft 183A. The bushing 286 has flanges at upper and lower parts thereof forming an endless track that receives bars of a latch arm 287. The latch arm is supported by a pivot on a mounting block 288 that is, in turn, secured to plate 285. The latch arm has a latch hook 289 that is displaced out of engagement with a complementary-shaped latch hook 290 only when a workpiece is pressed downwardly on the support, thereby rotating the latch arm about its support pivot. The position of the latch hook 290 is controlled by a cam 291 that is supported by a downwardly-extending portion of shaft 208. It will be appreciated that there is a cam 291 for each decorating head as shown in FIG. 15. Latch hook 290 carries a cam follower 292 that rolls about the cam 291 and displaces the latch bar in a direction which releases latch hook 289 therefrom. When this occurs, a frame assembly moves on slide supports toward the support 208. The frame assembly supports a squeegee 392 pressed by a spring into engagement with the side of the screen 280 which is opposite the workpiece. When the cam 291 drives the frame away from support 208, the frame retracts the squeegee from contact with the screen. This frame is comprised of parallel, spaced-apart guide rods 293 and 294. Guide rod 293 is carried by a slide block 295 and the guide rod 294 is supported by guide blocks 296 and 297. As shown in FIG. 23, the guide rod 294 has a tubular configuration in which a spring 298 is received with one end of the spring contacting an end wall in the rod while the opposite end of the spring contacts an upstanding abutment 299 that is bolted to plate 285. The force of the spring is applied to urge the rod 294 away from the abutment. A slide block 300 is secured to slide with rod 294 and thereby also move a slide rod 307 which is supported and freely slides in supports 296 and 297. Support 300 is engaged with one end of a spring 301 while the opposite end of the spring is supported by block 302 that is adjustably positioned on the end of a tension rod 303. The tension rod passes through support 300 and extends to latch hook 290 to which it is secured by a block 304. A nut member 305 forms an abutment for the support 300 under the force of spring 301 and thereby a resilient interconnection between rod 303 and rod 294. This resilient connection determines the amount of force that the squeegee applies to the screen independently of the force imposed by spring 298. By referring to FIG. 12, it can be seen that decorating head 154 can be releasably attached by bolts or the like at a preselected location about axis $A_3$ to the oscillating housing 156. In this way, the angular space between decorating heads 153 and 154 can be changed for a two-color decorating operation as previously described in regard to FIG. 21.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a method of decorating a cylindrical or conical surface of a workpiece, the steps comprising:

supporting the workpiece against rotation about a support axis spaced from said surface, oscillating said support about an oscillatory axis spaced from and generally parallel to said support axis, positioning a squeegee on a support at one side of a decorating screen to establish line contact between the opposite side of the screen and said surface, rolling the decorating screen along a tangential path while carried on said support about said surface and concurrently therewith, moving the squeegee by rotatably moving said support along an orbital path about said support axis to force a printing medium through the screen onto said surface at said line of contact, and moving said workpiece continuously about an axis generally corresponding to said oscillatory axis along a path of travel while supporting the workpiece against rotation.

2. The method according to claim 1 wherein said rolling a decorating screen includes rotating the decorating screen about a pivot axis forming a right angle with said support axis.

3. The method according to claim 1 wherein said step of moving said workpiece includes lifting a workpiece from a conveyor, carrying the workpiece along an arcuate path to a site selected for supporting of the workpiece against rotation, decorating the workpiece by said step of rolling the decorating screen along a tangential path and said step of moving the squeegee, and thereafter lifting the workpiece from the support and depositing the workpiece on a delivering means.

4. The method according to claim 3 wherein said step of moving a workpiece is carried out by engaging a workpiece with a vacuum chuck.

5. The method according to claim 3 where said step of moving a workpiece includes providing a plurality of workpiece support members adapted to move vertically on a continuously rotatable carousel above said support for a workpiece.

6. The method according to claim 5 wherein said step of moving a workpiece includes carrying a workpiece to each of a plurality of decorating stations, each decorating station having a support for a workpiece.

7. A method of decorating a cylindrical or conical surface of a workpiece, the steps comprising:

loading a workpiece onto a support, holding the workpiece against rotation about a support axis, oscillating the support and the workpiece about an axis of oscillation, rotating a platform by indexing movement about said support axis through a predetermined indexing angle, supporting a squeegee on said platform in juxtaposition relation to a surface of said workpiece to receive decoration thereon such that the squeegee orbits about said surface, supporting a printing screen for linear reciprocating motion on said platform between said squeegee and said workpiece, and reciprocating said screen in a timed relation with rotation of said platform such that said screen rolls about the surface of said workpiece without relative displacement therebetween while said squeegee orbits about the workpiece to force a printing medium through openings in said screen.

8. The method according to claim 7 including the further step of adjusting the movement of said screen relative to said workpiece to prevent relative displacement therebetween.

9. The method according to claim 7 including the further step of proving a plurality of such supports for workpieces on said support.

10. The method according to claim 9 wherein said step of loading a workpiece includes lifting a workpiece from a conveyor, carrying the workpiece along an arcuate path to a site selected for supporting of the workpiece against rotation, decorating the workpiece by said step of rolling the decorating screen along a tangential path and said step of moving the squeegee, and thereafter lifting the workpiece from the support and depositing the workpiece on a delivering means.

11. The method according to claim 10 wherein said step of moving a workpiece is carried out by engaging a workpiece with a vacuum chuck.

12. The method according to claim 10 wherein said step of moving a workpiece includes providing a plurality of workpiece support members adapted to move vertically on a continuously rotatable carousel above said support for a workpiece.

13. The method according to claim 10 wherein said step of moving a workpiece includes carrying a workpiece to each of a plurality of decorating stations, each decorating station having a support for a workpiece.

14. Apparatus to decorate a conical or cylindrical surface of a workpiece, said apparatus including the combination of, means for supporting a workpiece against rotation about a support axis spaced from a surface of the workpiece for printing thereon, a decorating screen having openings defining a desired pattern for printing on the surface of the workpiece, squeegee means for forcing a printing medium through openings in said screen forming said desired pattern, screen drive means for rolling said decorating screen along a tangential path about the surface of the workpiece, squeegee drive means including rack and pinion gears for moving said squeegee means in an orbital path about said support axis to force a printing medium through openings in said screen while in line contact with said surface of the workpiece, housing means movable about said axis for carrying said screen and squeegee drive means, and means to oscillate said housing means about an axis generally parallel and spaced from said support axis.

15. The apparatus according to claim 14 wherein said pinion gear is supported by said housing means to rotate about an axis intersecting and perpendicular to said support axis.

16. The apparatus according to claim 14 wherein said means for supporting a workpiece includes spaced-apart chuck members at least one of which is movable toward and away from the other for releasably engaging a workpiece.

17. The apparatus according to claim 14 wherein said screen drive means includes adjustable means to maintain zero relative displacement between said screen and said workpiece as the former rolls about the latter.

* * * * *